US006871633B1

(12) United States Patent
Date et al.

(10) Patent No.: US 6,871,633 B1
(45) Date of Patent: Mar. 29, 2005

(54) ABNORMALITY DIAGNOSIS APPARATUS FOR HIGH PRESSURE FUEL SYSTEM OF CYLINDER INJECTION TYPE INTERNAL COMBUSTION ENGINE

(75) Inventors: Toshiaki Date, Tokyo (JP); Takahiko Oono, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/956,108

(22) Filed: Oct. 4, 2004

(30) Foreign Application Priority Data

May 24, 2004 (JP) ..... 2004-153448

(51) Int. Cl.[7] ..... F02M 7/00
(52) U.S. Cl. ..... 123/447; 123/445; 123/446
(58) Field of Search ..... 123/445, 446, 123/447, 448, 457, 458, 459, 472

(56) References Cited

U.S. PATENT DOCUMENTS 3,817,231 A * 6/1974 O'Neill ..... 123/445
6,394,072 B1 * 5/2002 Yoshida et al. ..... 123/506

FOREIGN PATENT DOCUMENTS

JP 04-109052 * 10/1992
JP 06-213051 * 2/1994
JP 10-9028 A 1/1998
JP 11-82134 A 3/1999

* cited by examiner

*Primary Examiner*—Bibhu Mohanty
(74) *Attorney, Agent, or Firm*—Sughrue Mion, PLLC

(57) ABSTRACT

Apparatus for diagnosing high pressure fuel system of a cylinder injection type engine includes fuel pump (18), spill valve (33), fuel injectors (15), fuel pressure sensor (19) and fuel pressure control means (30). A control period for the pump (18) covers an intake period and a discharge period. The discharge period covers spill valve closing period and spill valve opening period. Fuel pressure control means (30) includes spill valve control period setting means for adjusting spill valve closing/opening periods, abnormality decision period detecting means for detecting as abnormality decision period the spill valve opening period during the discharge period in the engine operation, pressure change arithmetic means for determining change of the fuel pressure (PF) on the basis of the abnormality decision period, and diagnosing means for deciding as to abnormality of the spill valve (33), based on the change of the fuel pressure (PF).

10 Claims, 14 Drawing Sheets

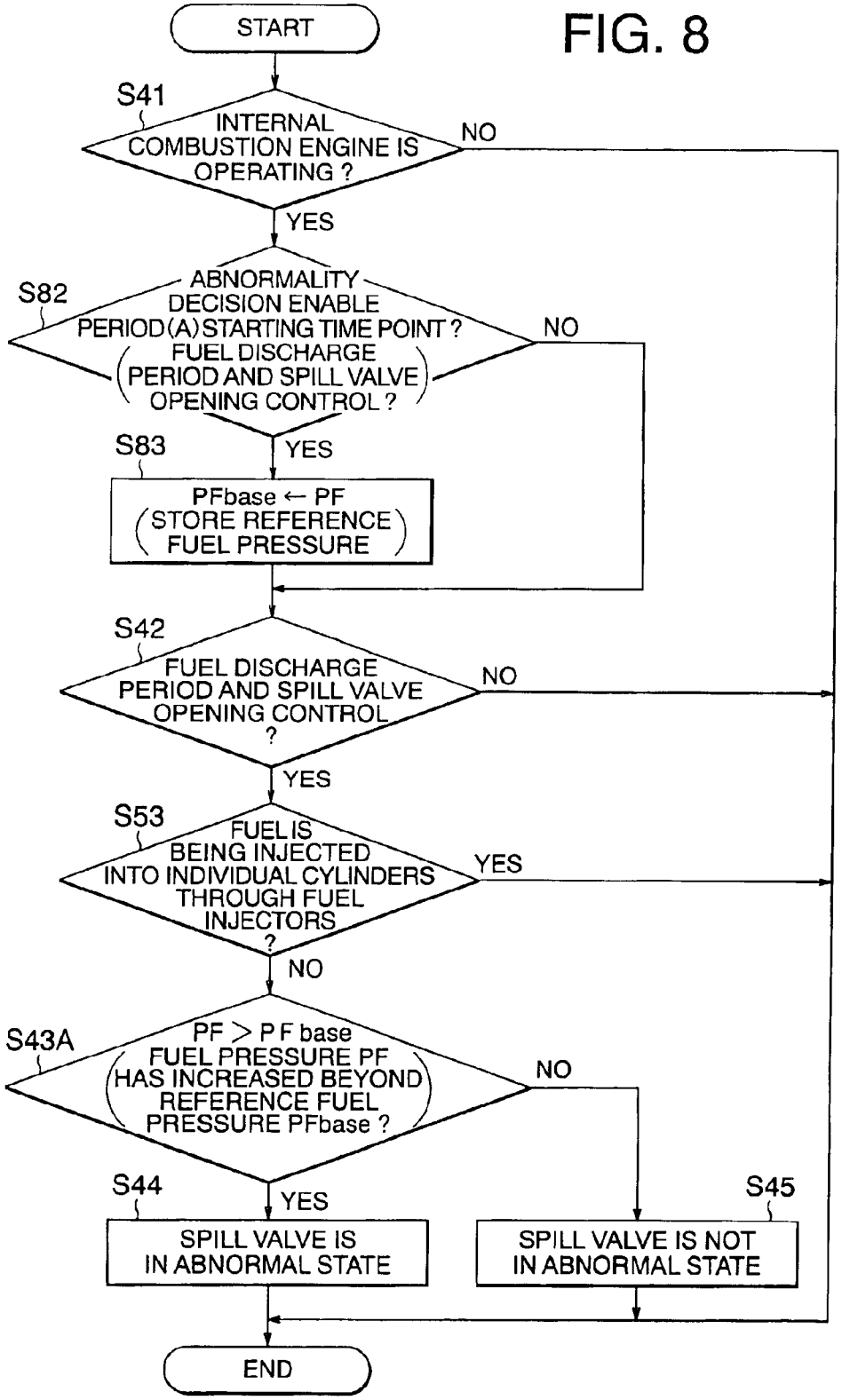
FIG. 8
START
S41
INTERNAL COMBUSTION ENGINE IS OPERATING ?
NO
YES
S82
ABNORMALITY DECISION ENABLE PERIOD (A) STARTING TIME POINT ? (FUEL DISCHARGE PERIOD AND SPILL VALVE OPENING CONTROL ?)
NO
YES
S83
PFbase ← PF (STORE REFERENCE FUEL PRESSURE)
S42
FUEL DISCHARGE PERIOD AND SPILL VALVE OPENING CONTROL ?
NO
YES
S53
FUEL IS BEING INJECTED INTO INDIVIDUAL CYLINDERS THROUGH FUEL INJECTORS ?
YES
NO
S43A
PF > PF base (FUEL PRESSURE PF HAS INCREASED BEYOND REFERENCE FUEL PRESSURE PFbase ?)
NO
YES
S44
SPILL VALVE IS IN ABNORMAL STATE
S45
SPILL VALVE IS NOT IN ABNORMAL STATE
END

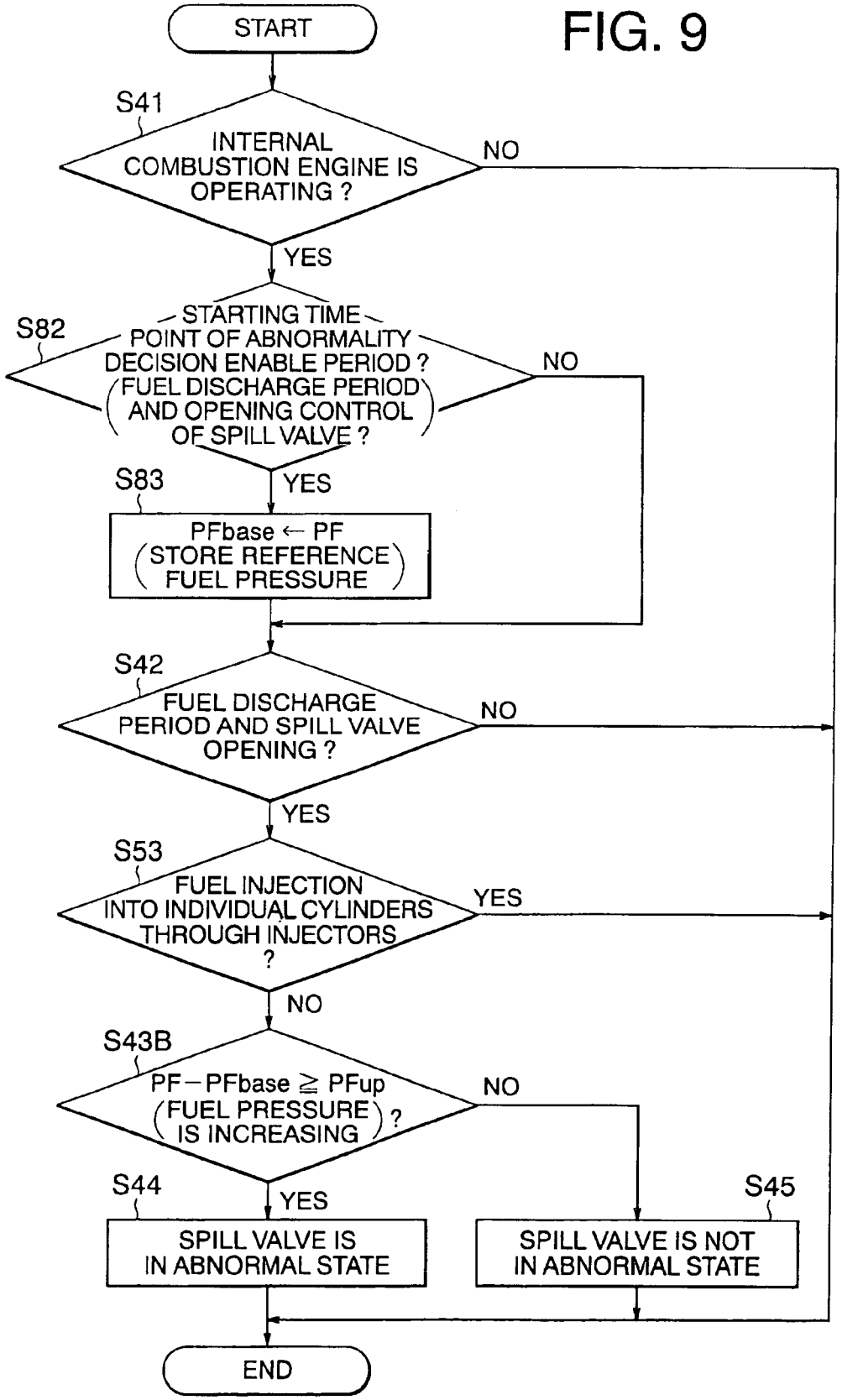
FIG. 9
START
S41
INTERNAL COMBUSTION ENGINE IS OPERATING ?
NO
YES
S82
STARTING TIME POINT OF ABNORMALITY DECISION ENABLE PERIOD ? (FUEL DISCHARGE PERIOD AND OPENING CONTROL OF SPILL VALVE ?)
NO
YES
S83
PFbase ← PF (STORE REFERENCE FUEL PRESSURE)
S42
FUEL DISCHARGE PERIOD AND SPILL VALVE OPENING ?
NO
YES
S53
FUEL INJECTION INTO INDIVIDUAL CYLINDERS THROUGH INJECTORS ?
YES
NO
S43B
PF−PFbase ≧ PFup (FUEL PRESSURE IS INCREASING) ?
NO
YES
S44
SPILL VALVE IS IN ABNORMAL STATE
S45
SPILL VALVE IS NOT IN ABNORMAL STATE
END

ABNORMALITY DIAGNOSIS APPARATUS FOR HIGH PRESSURE FUEL SYSTEM OF CYLINDER INJECTION TYPE INTERNAL COMBUSTION ENGINE

BACKGROUND OF THE INVENTION

1. Field of the Invention

The present invention generally relates to an apparatus for making diagnosis a high pressure fuel system of a cylinder injection type internal combustion engine as to whether or not the high pressure fuel system is suffering abnormality. More particularly, the present invention is concerned with an abnormality diagnosis apparatus for a high pressure fuel system of a cylinder injection type internal combustion engine for making diagnosis as to the abnormality of a spill valve which constitutes a part of the high pressure fuel system of the cylinder injection type internal combustion engine (also referred to as cylinder injection type engine or simply as the engine).

2. Background Technology

As a first hitherto known or conventional abnormality diagnosis apparatus for a high pressure fuel system of a cylinder injection type internal combustion engine, there is known an apparatus which is comprised, for example, of a pressure detecting means for detecting a pressure on a discharge side of a fuel feed pump, a control means for controlling a discharge quantity of the fuel feed pump on the basis of the detection result of the pressure detecting means so that the pressure on the discharge side of the fuel feed pump becomes equal to a desired or target pressure, and an abnormality determination or decision means for making decision that an abnormal state is prevailing when a discharge quantity control command value used for controlling the discharge quantity in the control means mentioned above becomes greater than a predetermined decision value which is not exceeded ordinarily by the discharge quantity control command value. (To this end, reference may have to be made to Japanese Patent Publication No. 2844881.)

With the first hitherto known apparatus, it is contemplated as an object thereof to detect with a high accuracy such abnormality that a sufficient or proper amount of fuel is not discharged due to the fuel leakage taking place ascribable to injuries of a fuel supply pipe or conduit, an accumulator and/or the like as well as abnormality brought about by the abnormality of the high pressure fuel pump, to thereby make it possible to take appropriate measures.

Further, as the second hitherto known or conventional apparatus, there has been proposed such an apparatus which is designed to determine the fuel leakage from a fuel feed system extending from the fuel feed pump to the fuel injector(s) of the engine on the basis of change of the fuel pressure prevailing within an accumulator during a predetermined period in which neither fuel feeding under pressure based on an amount of the fuel fed under pressure every predetermined period from the fuel feed pump when the internal combustion engine is operating nor fuel injection to individual cylinders through the fuel injections is executed (e.g. reference may have to be made to Japanese Patent Publication No. 3345933).

Further, as the third conventional apparatus, there is known an apparatus of such an arrangement in which the fuel pressure prevailing within the fuel system into which the fuel is discharged from the high pressure fuel pump and the engine rotation speed (rpm) are read, wherein when the engine rotation speed (rpm) is higher than a predetermined idling rotation speed (rpm) inclusive during a non-fuel-injection period and when the fuel pressure neither reaches nor exceeds a prescribed high pressure over a preset time or more within a predetermined time, it is regarded that there exists a possibility of abnormality taking place in the fuel system, whereby an abnormality flag is set with an abnormality lamp being lit. Besides, when it is determined that the abnormality flag is set, an on/off value interposed in a bypass passage interconnecting a discharge port of the fuel pump and the fuel tank is opened to thereby clear the pressure increase within the fuel system. (By way of example, reference may have to be made to Japanese Patent Application Laid-Open Publication No. 9028/1998 (JP-A-1998-9028).)

However, in general, as the abnormal state in which the spill valve in the high pressure fuel system becomes unmovable at the closed position, there can be mentioned an electrical abnormal state in which the spill valve becomes electrically unmovable at the closed position due to wire breaking and/or short circuit occurring in the spill valve and a mechanical or physical abnormal state, so to say, in which the spill valve becomes mechanically or physically unmovable due to admixture of foreign material(s) mixed with the fuel, wherein the electrical abnormal state can be detected with the aid of an abnormality detection circuit(s) (e.g. short circuit/breakage detection circuit) known in the art.

However, in the case where the spill valve is in the mechanical or physical abnormal state, this means that the spill valve is in the state insusceptible to being opened regardless of a valve open command issued to the spill valve from the ECU or alternatively the spill valve remains in the state fixedly secured at the closed position notwithstanding of the fact that the spill valve is undergoing the open control during the fuel discharge period of the high pressure fuel pump, indicating thus the electrically normal state. For this reason, the physical or mechanical abnormality of the fuel rail can not be detected with the conventional abnormality detection circuit.

Furthermore, as fourth conventional apparatus, there has also been proposed such an apparatus which is so designed as to monitor the behavior of the fuel pressure in the high pressure fuel system or alternatively the relation between the air-fuel ratio and the fuel injection pulse width for the fuel injector, wherein when behavior of the fuel pressure is abnormal or unless consistency is found in the relation between the air-fuel ratio and the fuel injection pulse width (i.e., when the conditions are satisfied), diagnosis can be performed with a high accuracy to the effect that the high pressure pump and a high pressure regulator which constitute parts of the high pressure fuel system are abnormal, fuel leakage from the high pressure fuel system takes place and/or that failure of opening the fuel injector occurs. (By way of example, reference may have to be made to Japanese Patent Application Laid-Open Publication No. 82134/1999 (J-P-1999-82134).

More specifically, upon diagnosis of the high pressure fuel system, when the fuel pressure of the high pressure fuel system has not attained a predetermined pressure even after lapse of a predetermined time since starting of the engine operation, or when the fuel pressure of the high pressure fuel system departs from a fuel pressure range which the fuel pressure of the high pressure fuel system can not ordinarily assume after the start of the engine operation or when the state in which the fuel injection pulse width exceeds a predetermined value has continued over a predetermined time period in the state where lean air-fuel mixture prevails (i.e., when the conditions for the abnormality decision are satisfied), the fourth conventional apparatus mentioned above diagnostically determines that the high pressure fuel system suffers abnormality.

With hitherto known abnormality diagnosis apparatus for the high pressure fuel system of the cylinder injection type internal combustion engine such as the first to fourth conventional apparatuses described above, abnormality of the high pressure fuel system can certainly be detected. However, it is impossible to identify discriminatively which location of the high pressure fuel system is in the abnormal state, giving rise to a problem.

Further, although the first to third conventional apparatus are certainly capable of detecting the abnormality of the high pressure fuel system which is primarily ascribable to the fuel leakage, these apparatuses can not detect the abnormal state of the spill valve in which the spill valve is unmovable at the closed position nevertheless of the opening control of the spill valve being carried out during the fuel discharge period of the high pressure fuel pump, incurring another problem.

SUMMARY OF THE INVENTION

In the light of the state of the art described above, it is an object of the present invention to provide an abnormality diagnosis apparatus for a high pressure fuel system of a cylinder injection type internal combustion engine, which apparatus is capable of detecting abnormal state with high reliability without fail when abnormality takes place in a spill valve which remains at the closed position regardless of the opening control thereof performed during the fuel discharge period of the high pressure fuel pump.

In view of the above and other objects which will become apparent as the description proceeds, there is provided according to a general aspect of the present invention an abnormality diagnosis apparatus for a high pressure fuel system of a cylinder injection type internal combustion engine, which apparatus includes an accumulator for storing a fuel in a high pressure state, a high pressure fuel pump for taking in the fuel supplied from a fuel tank to thereby feed under pressure the fuel to the accumulator, a spill valve for opening/closing a fuel relief passage which communicates a pressure increasing chamber of the high pressure fuel pump to a low pressure side thereof, injectors for supplying directly through injection into individual cylinders of the internal combustion engine the fuel of high pressure stored in the accumulator, a fuel pressure sensor for detecting as a fuel pressure the pressure of the fuel supplied to the injector, and a fuel pressure control means for variably setting a target value of the fuel pressure while setting the fuel pressure to the target value.

A control period of the high pressure fuel pump validated by means of the fuel pressure control means includes a fuel intake period for taking in the fuel and a fuel discharge period for discharging the fuel, the fuel discharge period including a spill valve closing control period for close-controlling the spill valve for feeding the fuel under pressure to the accumulator from the pressure increasing chamber, and a spill valve opening control period for open-controlling the spill valve for releasing the fuel to the low pressure side from the pressure increasing chamber.

The fuel pressure control means includes a spill valve control period setting means for adjusting the spill valve closing control period and the spill valve opening control period, an abnormality decision enable period detecting means for detecting as an abnormality decision enable period the spill valve opening control period with falls within the fuel discharge period in the course of operation of the internal combustion engine, a fuel pressure change arithmetic means for arithmetically determining change of the fuel pressure on the basis of the abnormality decision enable period, and an abnormality diagnosing means for making decision as to abnormality of the spill valve on the basis of the change of the fuel pressure.

By virtue of the teachings of the present invention incarnated in the abnormality diagnosis apparatus for the high pressure fuel system of the cylinder injection type internal combustion engine as described above, such abnormal state can be detected with high reliability without fail in which the spill valve remains at the closed position even though the opening control of the spill valve is performed during the period in which the fuel is discharged from the high pressure fuel pump.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 8 is a flow chart for illustrating operation of an abnormality diagnosis apparatus for a high pressure fuel system of a cylinder injection type engine according to a fourth embodiment of the present invention;

FIG. 9 is a flow chart for illustrating operation of an abnormality diagnosis apparatus for a high pressure fuel system of a cylinder injection type engine according to a fifth embodiment of the present invention;

DESCRIPTION OF THE PREFERRED EMBODIMENTS

Figure 1:
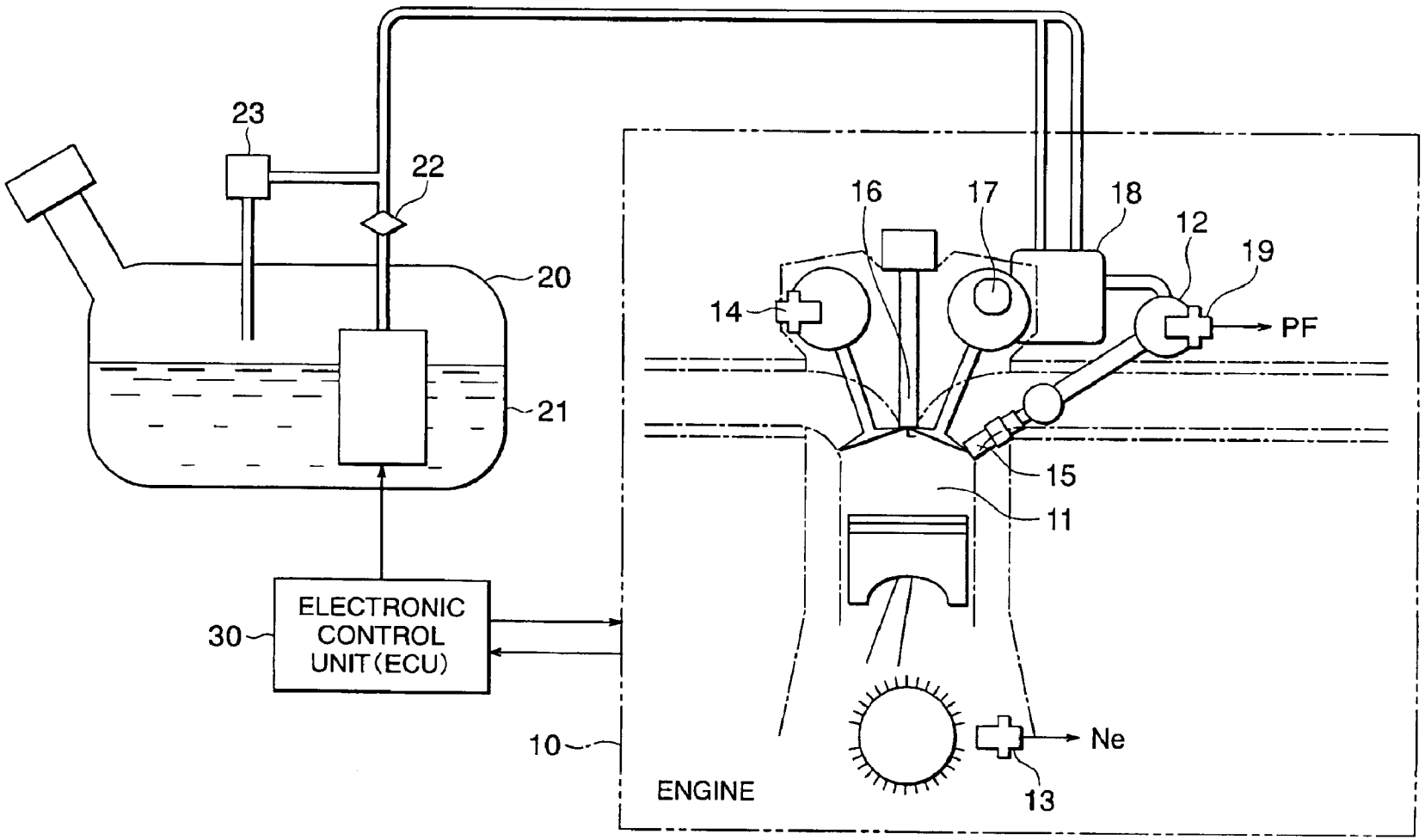
FIG. 1 is a block diagram showing generally and schematically an abnormality diagnosis apparatus for a high pressure fuel system of a cylinder injection type internal combustion engine according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

Now, the present invention will be described in detail in conjunction with a first embodiment thereof by referring to the drawings.

FIG. 1 is a block diagram showing generally and schematically a fuel pressure control apparatus for a cylinder injection type internal combustion engine to which the first embodiment of the present invention can be applied. In this conjunction, it is assumed, only by way of example, that the fuel control apparatus mentioned above is implemented as an internal part of a control apparatus for the internal combustion engine destined to be installed on a motor vehicle (i.e., on-vehicle control apparatus).

Figure 2:
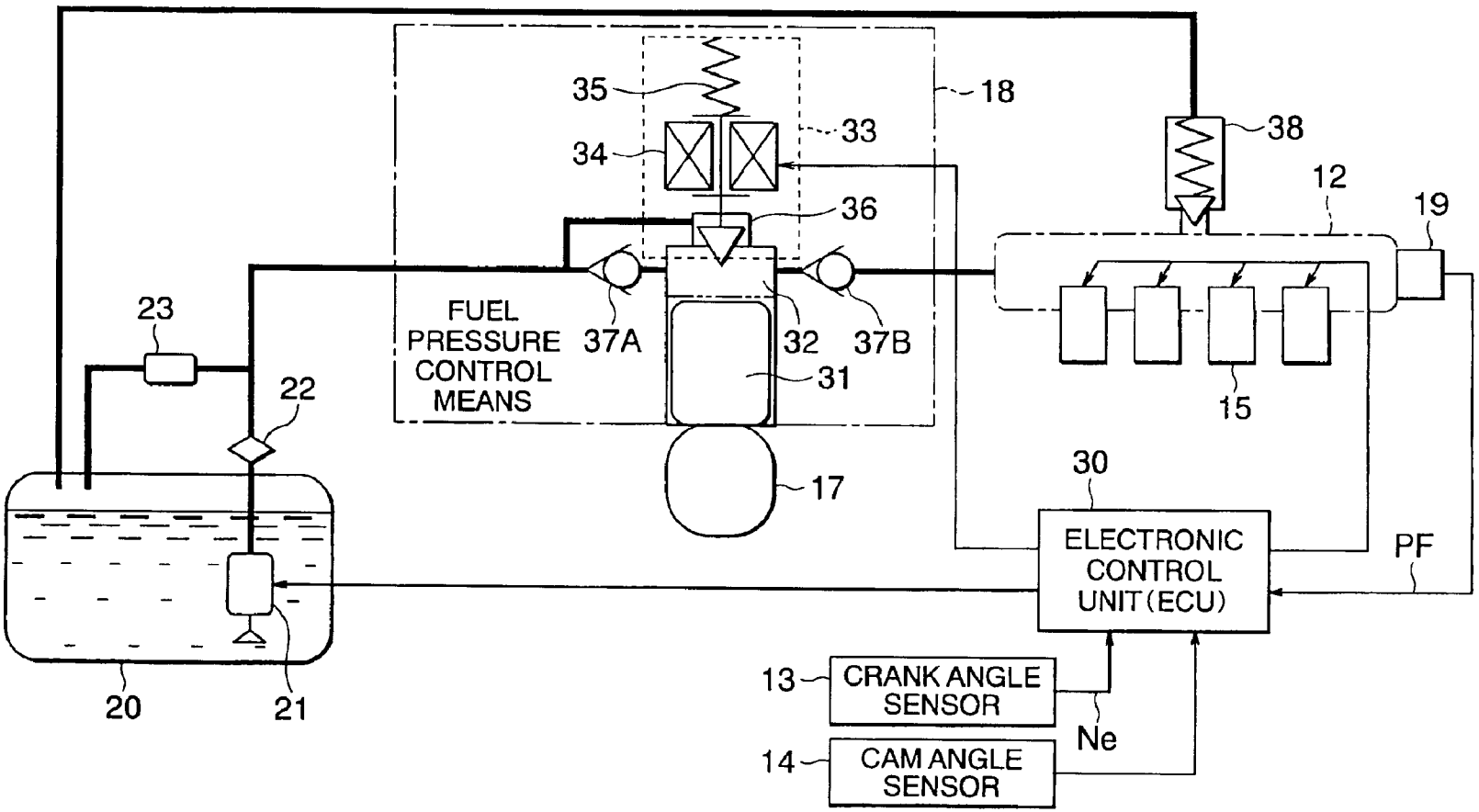
FIG. 2 is a block diagram showing an arrangement of a fuel system of the abnormality diagnosis apparatus for the high pressure fuel system of the cylinder injection type internal combustion engine according to the first embodiment of the invention.

FIG. 2 is a block diagram showing a peripheral arrangement of the fuel system shown in FIG. 1.

Referring to FIG. 1, an engine 10 constituting a major part of the cylinder injection type internal combustion engine includes a plurality of cylinders each having a combustion chamber 11 into which a fuel of high pressure fed through a fuel rail (accumulator) 12 is directly injected. Incidentally, in the figures, arrangement associated with only one cylinder is representatively shown with a view to simplifying and clarifying the illustration.

The engine 10 has a crank shaft (not shown) in association with which a crank angle sensor 13 is provided, while a cam angle sensor 14 is provided in association with a cam shaft (not shown either). The crank angle sensor 13 is designed to output or generate a pulse signal corresponding to a rotation speed (rpm) Ne of the engine 10.

Mounted within each of the combustion chambers 11 of the engine cylinders is a fuel injector 15 for directly injecting the fuel into the combustion chamber 11 as well as a spark plug 16 for producing a spark to burn the fuel.

Further, a pump cam 17 is mounted on the cam shaft for the exhaust valves (or intake valves) of the engine 10 so that the pump cam 17 can rotate simultaneously with the cam shaft.

A high pressure fuel pump 18 installed in association with the pump cam 17 has an output port communicated to the fuel rail 12 and is so adjustably driven that a fuel pressure PF prevailing within the fuel rail 12 coincides with a desired or target fuel pressure PFo, details of which will be elucidated later on.

At this juncture, it should be mentioned that an electric signal indicative of the fuel pressure within the fuel rail 12 has undergone an averaging or filtering processing by means of an electronic control unit (hereinafter also referred to simply as "ECU") 30. Further, the desired or target fuel pressure PFo is variably set on the basis of e.g. the engine rotation speed (rpm) Ne or load information of the engine 10.

The fuel rail 12 is provided with a fuel pressure sensor 19 for outputting a signal indicative of the fuel pressure PF within the fuel rail 12 as the feedback information.

The high pressure fuel pump 18 has an input port which is communicated to a fuel tank 20. Disposed within the fuel tank 20 is a feed pump 21 for pumping up the fuel under the control of the ECU 30 mentioned previously.

Further provided on the output side of the feed pump 21 are a filter 22 for purifying the fuel and a regulator 23 for adjusting or regulating the pressure of the fuel supplied or fed to the high pressure fuel pump 18.

In FIG. 2, there are shown in the concrete the structures of the high pressure fuel pump 18 and the fuel rail 12, respectively, in association with the fuel system extending from the fuel tank 20.

Driving operations of the fuel injectors 15, the high pressure fuel pump 18 and the feed pump 21 disposed within the high pressure fuel pump 18 are placed under the control of the ECU 30.

Referring to FIG. 2, the ECU 30 serves to detect the engine rotation speed (rpm) Ne on the basis of the output information of the crank angle sensor 13 and at the same time identify discriminatively the individual cylinders from one another on the basis of the information derived from the output of the cam angle sensor 14.

In addition, the ECU 30 is designed to arithmetically determine the fuel injection timing as well as the ignition timing of the individual cylinders to thereby control the driving operation or actuation of various associated actuators. Moreover, the ECU 30 is in charge of performing a feedback control for forcing the fuel pressure PF prevailing within the fuel rail 12 to reach the desired or target fuel pressure PFo on the basis of the output information (the fuel pressure PF) of the fuel pressure sensor 19.

The high pressure fuel pump 18 includes a piston 31 moved up/down by the pump cam 17, as viewed in FIG. 2, and a pressure increasing chamber 32 which cooperates with the piston 31 and a spill valve 33 for adjusting the quantity of fuel to be fed under pressure to the fuel rail 12.

The spill valve 33 is composed of a coil assembly 34 which is caused to move upwardly, as viewed in the figure, upon electrical energization, a spring 35 for resiliently urging downwardly the coil assembly 34 and a valve element 36 disposed at a bottom end of the coil assembly 34.

A first check valve 37A and a second check valve 37B are inserted at an input port side of the pressure increasing chamber 32 and at an output port side thereof which leads to the fuel rail 12.

On the other hand, the fuel rail 12 is provided with a pressure relief valve 38 which is so designed as to open when the fuel pressure PF within the fuel rail 12 reaches the valve opening pressure of the pressure relief valve 38 to thereby allow the fuel within the fuel rail 12 to flow back to the fuel tank 20.

Referring to FIGS. 1 and 2, the ECU 30 constitutes a fuel pressure control means for setting the desired or target fuel pressure PFo on the basis of the engine rotation speed (rpm) Ne, the engine load information and others to thereby control the operation of the high pressure fuel pump 18 such that the fuel pressure PF prevailing within the fuel rail 12 becomes equal to the target fuel pressure PFo.

To this end, the ECU 30 includes a spill valve control period setting means for regulating or adjusting a spill valve closing control period and a spill valve opening control period (described later on), an abnormality decision enable period detecting means for detecting as an abnormality decision enable period the spill valve opening control period which falls within or overlaps a fuel discharge period during which the operation of the engine 10, a fuel pressure change arithmetic means for arithmetically determining change of the fuel pressure PF on the basis of the abnormality decision enable period, and an abnormality diagnosing means for making diagnosis as to abnormality of the spill valve 33 on the basis of the change of the fuel pressure PF.

Further, the ECU 30 is designed to control individually the fuel injectors 15 and the spark plugs 16 on a cylinder-by-cylinder basis to thereby control the fuel injection and the ignition timing at each of the cylinders. In that case, each fuel injector 15 and each spark plug 16 are activated or driven in response to a fuel injector driving signal and an ignition signal, respectively, which are supplied from the ECU 30.

Next, referring to FIGS. 1 and 2, description will be made of the ordinary fuel pressure feedback control operation (operation for setting the pressure of the fuel to be supplied to the fuel injector 15) which is carried out through cooperation of the ECU 30 and the high pressure fuel pump 18.

Firstly, the fuel pumped up from the fuel tank 20 by means of the feed pump 21 is forced to pass through the filter 22. In succession, the fuel pressure is regulated or adjusted by the regulator 23 to be subsequently introduced into the high pressure fuel pump 18.

The piston 31 disposed within the high pressure fuel pump 18 is caused to move up/down by means of the pump cam 17 which rotates together with the cam shaft, as a result of which the volume of the pressure increasing chamber 32 changes. Thus, the fuel within the pressure increasing chamber 32 is compressed or pressurized to be introduced into the fuel rail 12 by way of the second check valve 37B.

In this way, the fuel is fed under pressure to the fuel rail 12 by means of the high pressure fuel pump 18. In this conjunction, it is to be noted that the amount or quantity of the fuel fed under pressure to the fuel rail 12 during the fuel discharge period is adjusted or regulated by controlling the valve opening/closing period of the valve element 36 of the spill valve 33. Hereinafter, the valve elements 36 and the spill valve 33 will also be collectively referred to simply as "spill valve 33" only for the convenience of description.

In the description which follows, the period during which the pump cam 17 moves downwardly is referred to as the fuel intake period while the period during which the pump cam 17 moves upwardly is referred to as the fuel discharge period.

The valve element 36 housed within the spill valve 33 is forced to move upwardly in response to a power signal applied to the coil assembly 34 (i.e., upon electrical energization of the coil assembly 34) from the ECU 30 against the spring force or urging effort of the spring 35, as a result of which a passage formed at a lower end portion of the spill valve 33 and communicated to the pressure increasing chamber 32 is opened.

When the passage mentioned just above is opened with the valve element 36 moving upwardly, the pressure increasing chamber 32 is put into communication with the input port side, which results in that the fuel resident within the pressure increasing chamber 32 flows backward to the input port side, whereby the fuel feeding to the fuel rail 12 is stopped. Consequently, no fuel is discharged into the fuel rail 12 from the high pressure fuel pump 18.

On the other hand, upon deenergization (i.e., upon interruption of energization) of the coil assembly 34, the latter is caused to move downwardly under the urging effort of the spring 35. Consequently, the passage mentioned above is closed. Thus, the fuel of high pressure is discharged into the fuel rail 12 from the high pressure fuel pump 18.

At that time point, the pressure relief valve 38 opens when the fuel pressure PF attains the valve opening pressure, which naturally results in that the fuel within the fuel rail returns to the fuel tank 20.

Further, the fuel pressure sensor 19 detects the fuel pressure PF prevailing within the fuel rail 12. The detection output of the fuel pressure sensor 19 is furnished to the ECU 30 for contributing to enhancing the fuel pressure feedback control carried out by the ECU.

The fuel of high pressure within the fuel rail 12 undergone the fuel pressure control in the manner described above is injected directly into the combustion chamber 11 of the engine cylinder from the fuel injector 15.

The fuel pressure control described above is a processing operation for adjusting or regulating the quantity of fuel to be fed under pressure to the fuel rail 12 so that the fuel pressure PF assumes the desired or target fuel pressure PFo (i.e., low pressure spill type variable fuel pressure control).

In this conjunction, it should however be mentioned that in the abnormality diagnosis apparatus for the high pressure fuel system of the internal combustion engine according to the first embodiment of the invention, such regulation processing that the fuel fed under pressure to the fuel rail 12 is spilled so as to realize the target fuel pressure PFo (i.e., the high pressure spill type variable fuel pressure control, so to say) may equally be adopted.

Figure 3:
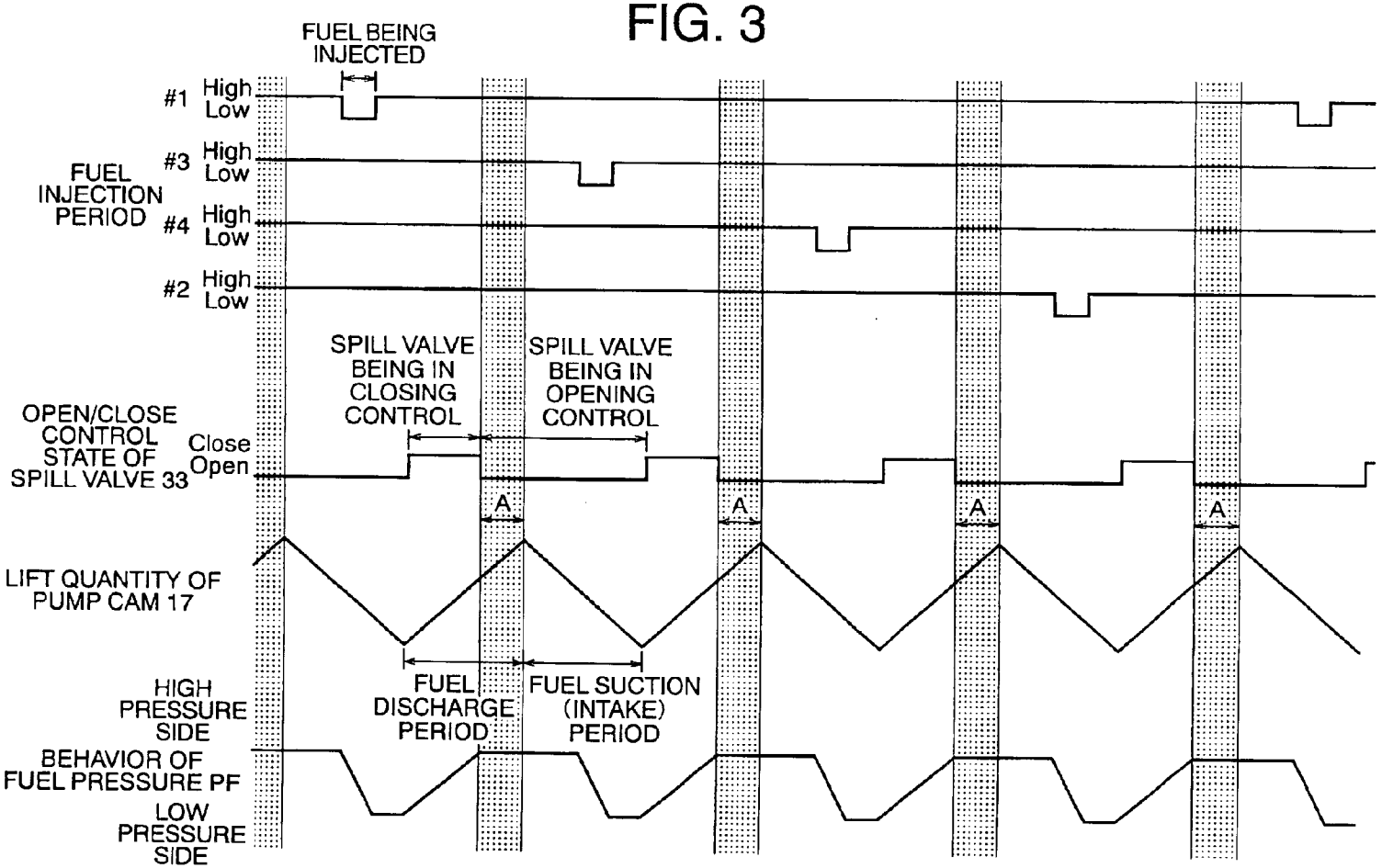
FIG. 3 is a timing chart for illustrating operation of the high pressure fuel system according to the first embodiment of the invention.

Now, referring to a timing chart shown in FIG. 3, description will turn to behaviors of the fuel pressure within the fuel rail 12 in the fuel pressure control apparatus for the cylinder injection type internal combustion engine implemented in the structure described above by reference to FIGS. 1 and 2.

Incidentally, in FIG. 3, time is taken along the abscissa with the fuel injection period being shown at low level time intervals "Low" for a plurality of cylinders (#1 to #4), respectively.

Further, it is shown that in the open/close control state of the spill valve 33, the spill valve 33 is in the closing control process for the time interval of "Close" level while the opening control of the spill valve 33 (spill valve opening control) is performed during a time interval of "Open" level.

On the other hand, concerning the lift quantity of the pump cam 17, the period during which the lift of the pump cam 17 rises corresponds to the fuel discharge period, while the period during which the lift of the pump cam 17 lowers corresponds to the fuel discharge period.

Further, as behaviors of the fuel pressure, there are shown those at high and low pressure levels, respectively.

As can be appreciated from the above, the period during which the high pressure fuel pump 18 is controlled by the ECU (fuel pressure control means) 30 (hereinafter this period will also be referred to as the control period) covers or encompasses a fuel intake period for taking in the fuel and a fuel discharge period for discharging the fuel.

On the other hand, the fuel discharge period includes or encompasses the spill valve closing control period for performing the closing control of the spill valve 33 in order to feed the fuel under pressure to the fuel rail (accumulator) 12 from the pressure increasing chamber 32 and the spill valve opening control period for performing the opening control of the spill valve 33 to allow the fuel to relief or spill to the low pressure side from the pressure increasing chamber 32.

Now, let's consider the behavior of the fuel within the fuel rail 12 in the course of operation of the engine 10. It can be seen that the fuel is fed under pressure to the fuel rail 12 from the high pressure fuel pump 18, causing the fuel pressure PF to increase, in the case where the open/close control state of the spill valve 33 is in the closing control process during the fuel discharge period.

Further, it can be seen that the fuel pressure PF is low "during the fuel injection" to the individual cylinders, respectively, from the fuel injector 15.

Additionally, it can be seen that during the period in which neither the under-pressure fuel feeding from the high-pressure fuel pump 18 nor the fuel junction into the individual cylinders through the respective injectors 15 is executed, the fuel pressure PF remains constant.

Furthermore, the behavior of the fuel pressure during the time interval "A" for which the spill valve 33 is undergoing the opening control during the fuel discharge period (i.e., which period during the lift quantity of the pump cam 17 is increasing) is such that the fuel pressure PF becomes lower when the fuel injection into the cylinder from the injector 15 is executed while the fuel pressure PF becomes constant unless the fuel injection is performed.

More specifically, in the time interval "A", the spill valve 33 is undergoing the opening control although the pump cam 17 is moving upward. Consequently, the pressure increasing chamber 32 and the inlet port are communicated with each other, as a result of which the fuel within the pressure increasing chamber 32 returns to the inlet port. Accordingly, no increasing of the fuel pressure PF can take place.

As is apparent from the foregoing, in the ordinary operation state, the fuel pressure PF does not increase during the time interval "A". Consequently, in case the fuel pressure PF should increase or rise during the time interval A, this means that there takes place an abnormal state in which the fuel is fed under pressure to the fuel rail 12 from the high pressure fuel pump 18.

In other words, in view of the fact that the fuel pressure PE increases nevertheless the command value issued to the spill valve 33 from the ECU 30 indicates the "opening control", the fuel pressure PF increases, it can be determined that there occurs such abnormal state that the spill valve 33 becomes unmovable on the valve-closed side in the course of the upward moving of the pump cam 17.

Now, by referring to the flow chart shown in FIG. 4, description will be made of the abnormality diagnosis processing of the spill valve 33 as carried out by the abnormality diagnosis apparatus for the high pressure fuel system of the cylinder injection type internal combustion engine according to the first embodiment of the present invention.

Figure 4:
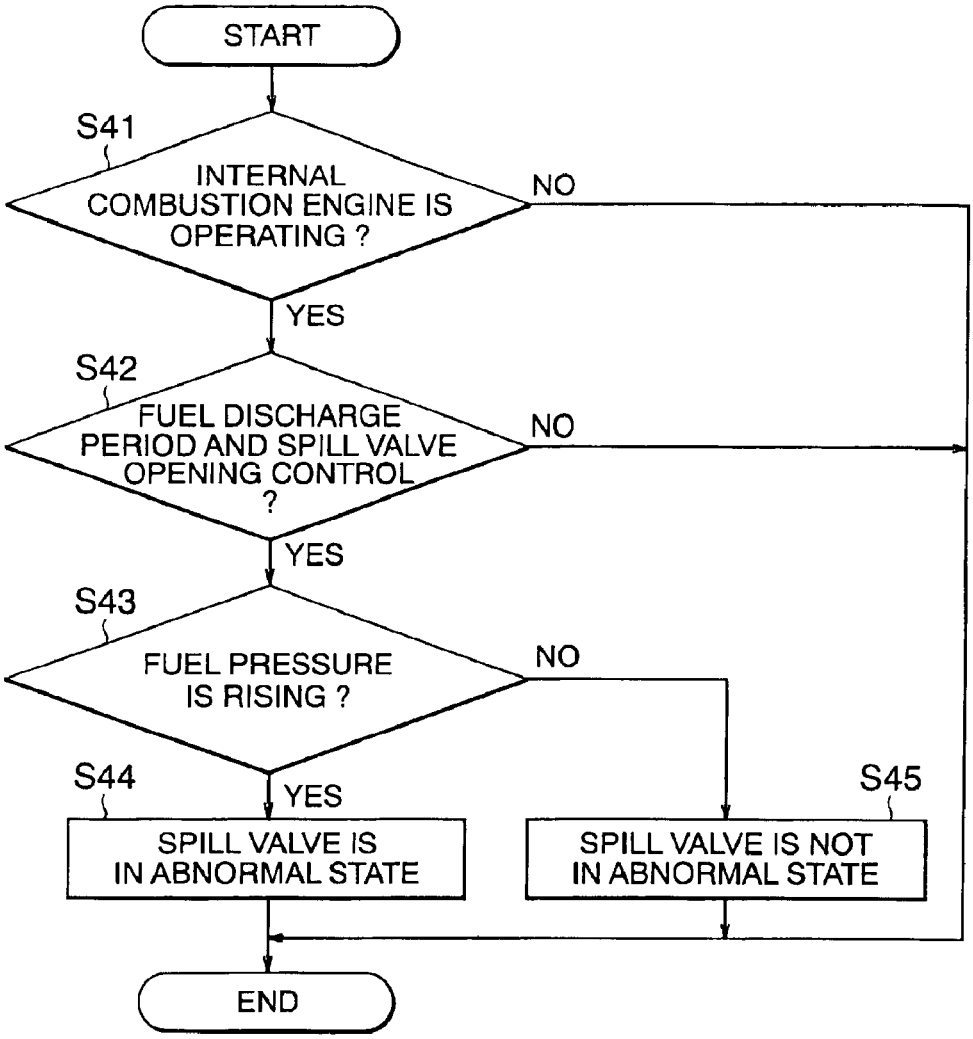
FIG. 4 is a flow chart for illustrating operation of an abnormality diagnosis apparatus for a high pressure fuel system of the cylinder injection type engine according to the first embodiment of the invention.

Referring to FIG. 4, the ECU (Electronic Control Unit) 30 firstly makes decision as to whether or not the internal combustion engine is operating (step S41). When it is determined that the internal combustion engine is not operating (i.e. when the decision step S41 results in negation "NO"), the processing routine illustrated in FIG. 4 is immediately terminated.

On the contrary, when decision made in the step S41 results in that the engine is operating (i.e., when the decision step S41 results in affirmation "YES"), it is then decided whether the spill valve 33 is undergoing the opening control during the fuel discharge period in the step S42. Unless the fuel discharge period is validated or when the spill valve 33 is not undergoing the opening control (i.e., when the step S41 results in "NO"), the processing routine illustrated in FIG. 4 is immediately terminated.

By contrast, when it is determined in the step S42 that the fuel discharge period is validated and that the spill valve 33 is undergoing the opening control (i.e., when the step S42 results in "YES"), decision is then made whether or not the fuel pressure PF within the fuel rail 12 is rising (step S43).

By the way, the decision whether the spill valve 33 is being in the opening control or not, which decision is executed in the processing step S42, can be made, by way of example, on the basis of the power feeding signal supplied to the coil assembly 34 incorporated in the spill valve 33 from the ECU 30.

When it is decided in the step S43 that the fuel pressure PF is rising (i.e., when the step S42 is "YES"), it is diagnostically determined that the spill valve 33 suffers abnormality (step S44). On the contrary, when it is determined that the fuel pressure PF is not rising in the step S43 (i.e., when the step S43 is "NO"), it is then diagnostically determined that the spill valve 33 suffers no abnormality in a step S45, whereupon the processing routine illustrated in FIG. 4 comes to an end.

As is apparent from the foregoing, the ECU 30 is designed or programmed to diagnose the spill valve 33 as to the abnormality thereof on the basis of the change of the fuel pressure PF detected by the fuel pressure sensor 19 during the period for which the spill valve 33 is undergoing the opening control by spilling the fuel to the low pressure side from the pressure increasing chamber 32 of the engine 10 in the fuel discharge period of the high pressure fuel pump 18 in the course of operation of the internal combustion engine.

By virtue of the diagnose processing described above, even the physical or mechanical abnormal state of the spill valve 33 that cannot be detected with the hitherto known detection circuit which is capable of coping with only the electrical abnormal states such as mentioned previously (e.g. electrically brought-about sticking of the spill valve 33 at the valve-closed position due to breaking of wire, short circuit or the like occurring in the spill valve 33) can discriminatively be detected. Parenthetically, with the phrase "the physical or mechanical abnormal states" of the spill valve 33, it is contemplated to mean such a fault that the spill valve 33 is physically or mechanically caused to become unmovable at the valve-closed position due to admixing of foreign material(s) or the like, making it impossible to open the spill valve 33 nevertheless of the valve opening command issued to the spill valve 33 from the ECU 30.

Embodiment 2

Figure 5:
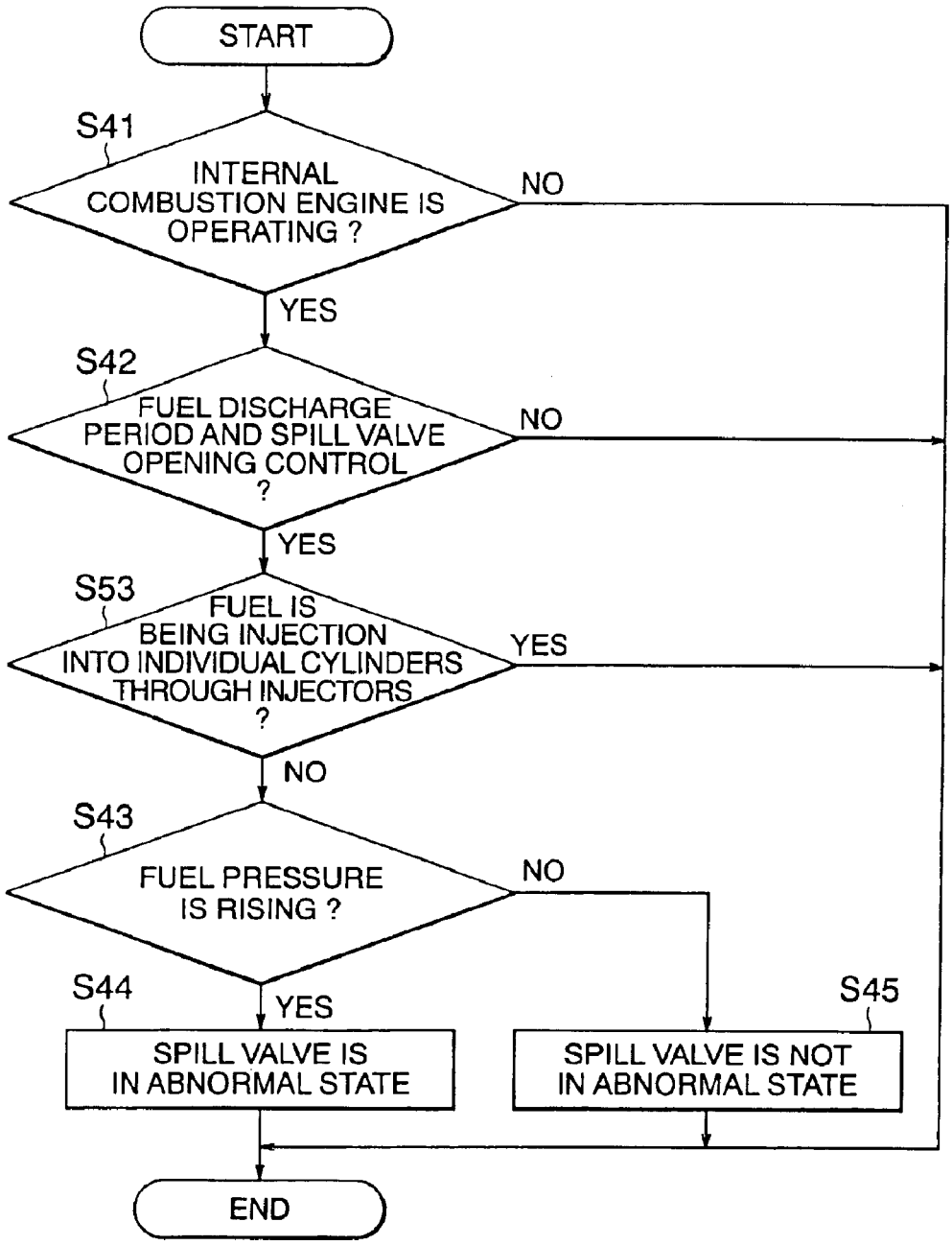
FIG. 5 is a flow chart for illustrating operation of the abnormality diagnosis apparatus for a high pressure fuel system of a cylinder injection type engine according to a second embodiment of the present invention.

In the case of the abnormality diagnosis apparatus for the high pressure fuel system of the cylinder injection type engine according to the first embodiment of the present invention, no consideration has been paid to the occurrence/nonoccurrence of the fuel injection as the conditions for enabling the abnormality diagnosis. In the case of the abnormality diagnosis apparatus for the high pressure fuel system of the cylinder injection type internal combustion engine according to a second embodiment of the present invention, occurrence/nonoccurrence of the fuel injection is taken into account as the conditions for enabling the abnormality diagnosis, as shown in FIG. 5.

In the following, the spill valve abnormality diagnosis processing taught by the present invention incarnated in the second embodiment thereof will be described by referring to the flow chart shown in FIG. 5.

Incidentally, it should firstly be mentioned that the general arrangement of the apparatus according to the second embodiment of the invention is essentially same as that described hereinbefore in conjunction with FIGS. 1 and 2 except for some functions incorporated in the ECU 30, which will be made apparent below.

In the abnormality diagnosis apparatus for the high pressure fuel system of the cylinder injection type engine now under consideration, the abnormality decision enable period detecting means incorporated in the ECU 30 is so designed as to detect as the abnormality decision enable period the spill valve opening control period which falls within the fuel discharge period of the high pressure fuel pump 18 in the operating state of the internal combustion engine and during which the spill valve 33 is opened to allow the fuel to be spilled or relieved to the low pressure side from the pressure increasing chamber 32 of the high pressure fuel pump 18 and during which the fuel injections into the cylinders through the fuel injectors are not carried out.

In FIG. 5, the processings (steps S41 to S45) similar to those described hereinbefore by reference to FIG. 4 are omitted from description in detail.

Referring to FIG. 5, when it is decided in the step S41 that the engine is operating (i.e., when the decision step S41 is "YES") and when it is decided in the step S42 that the spill valve 33 is undergoing the valve opening control during the fuel discharge period (i.e., when the step S42 is "YES"), decision is then made as to whether the fuel of high pressure is being injected into the cylinder through the fuel injector 15 (step S53).

When it is determined in the step S53 that the fuel is being injected (i.e., when the step S53 is "YES"), the processing routine shown in FIG. 5 is immediately terminated, whereas when it is determined that no fuel injection is taking place (i.e., when the step S53 is "NO"), the processing proceeds to a step S43.

By the way, the decision as to whether or not the fuel of high pressure is being injected into the cylinders of the engine 10 through the respective injectors 15 in the step S53 may be realized on the basis of the driving signal supplied to the fuel injectors 15 from the ECU 30.

In succession, when it is determined in the step S43 that the fuel pressure PF within the fuel rail 12 is rising (i.e., when the step S43 is "YES"), similarly to the case described previously, it is diagnostically determined that the spill valve 33 suffers abnormality (step S44), whereas unless the fuel pressure PF is rising (i.e., when the step S43 is "NO"), it is then diagnostically determined or diagnosed that the spill valve 33 suffers no abnormality (step S45).

As is apparent from the above, the abnormality decision enable period detecting means incorporated in the ECU 30 is so designed as to detect as the abnormality decision enable period the period which falls within the fuel discharge period of the high pressure fuel pump 18 in the engine operating state and during which the spill valve 33 is opened to allow the fuel to be spilled or relieved to the low pressure side from the pressure increasing chamber 32 of the high pressure fuel pump 18 and during which the fuel injection into the cylinders through the injectors 15 is not carried out.

Obviously, since the period during which the fuel pressure PF becomes low due to the fuel injection into the cylinder through the injector 15 is excluded from the period for enabling the decision as to the abnormality of the spill valve 33, the abnormality diagnosis of the spill valve 33 can be validated only during the period in which the fuel pressure behavior is constant. This in turn means that the abnormality diagnosis can be realized with high reliability (e.g. improved detection performance and enhanced insusceptibility to the erroneous or false detection).

Embodiment 3

In the case of the abnormality diagnosis apparatus for the high pressure fuel system of the cylinder injection engine according to the first embodiment of the present invention, no description has been made concerning the processing for inhibiting the fuel injection and for an enforcive opening control of the spill valve 33 in an abnormality diagnosis interval. In the abnormality diagnosis apparatus for the high pressure fuel system according to a third embodiment of the present invention the fuel injection for all the cylinders and the enforcive opening control of the spill valve 33 are adopted, as is illustrated in FIGS. 6 and 7.

In the following, referring to a timing chart shown in FIG. 6 and a flow chart shown in FIG. 7, description will be made of the abnormality diagnosis apparatus for the high pressure fuel system of the cylinder injection type engine according to the third embodiment of the present invention in which an abnormality diagnosis interval B is set for the spill valve 33 during a period over which the fuel injection for all the cylinders are inhibited and during which an enforcive opening control of the spill valve 33 is being effectuated.

By the way, it should be mentioned that the general arrangement of the apparatus according to the third embodiment of the invention is essentially same as that shown in FIGS. 1 and 2 except for some functions incorporated in the ECU 30, which will be made apparent as the description proceeds.

Figure 6:
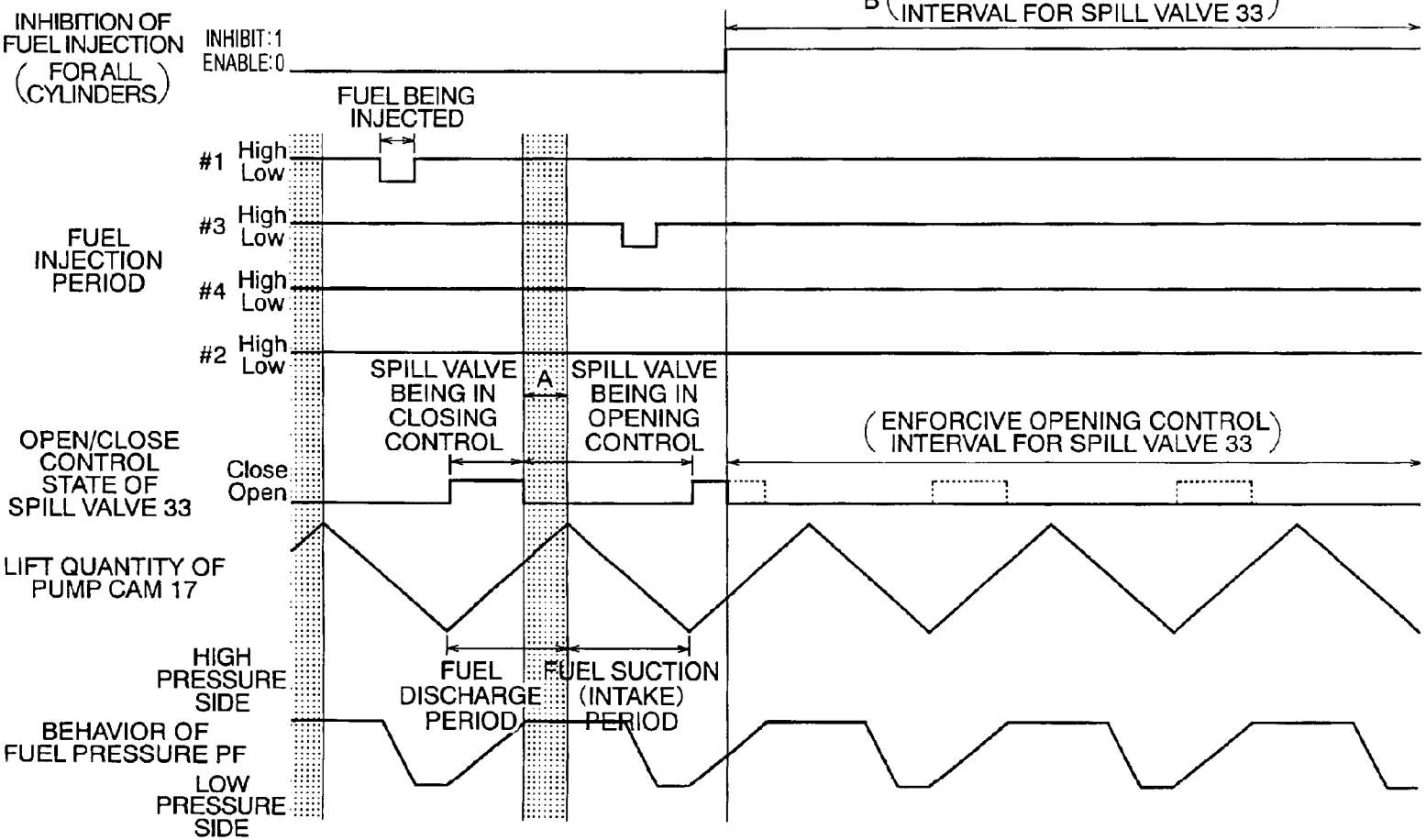
FIG. 6 is a timing chart for illustrating operation of a high pressure fuel system according to a third embodiment of the present invention.
Figure 7:
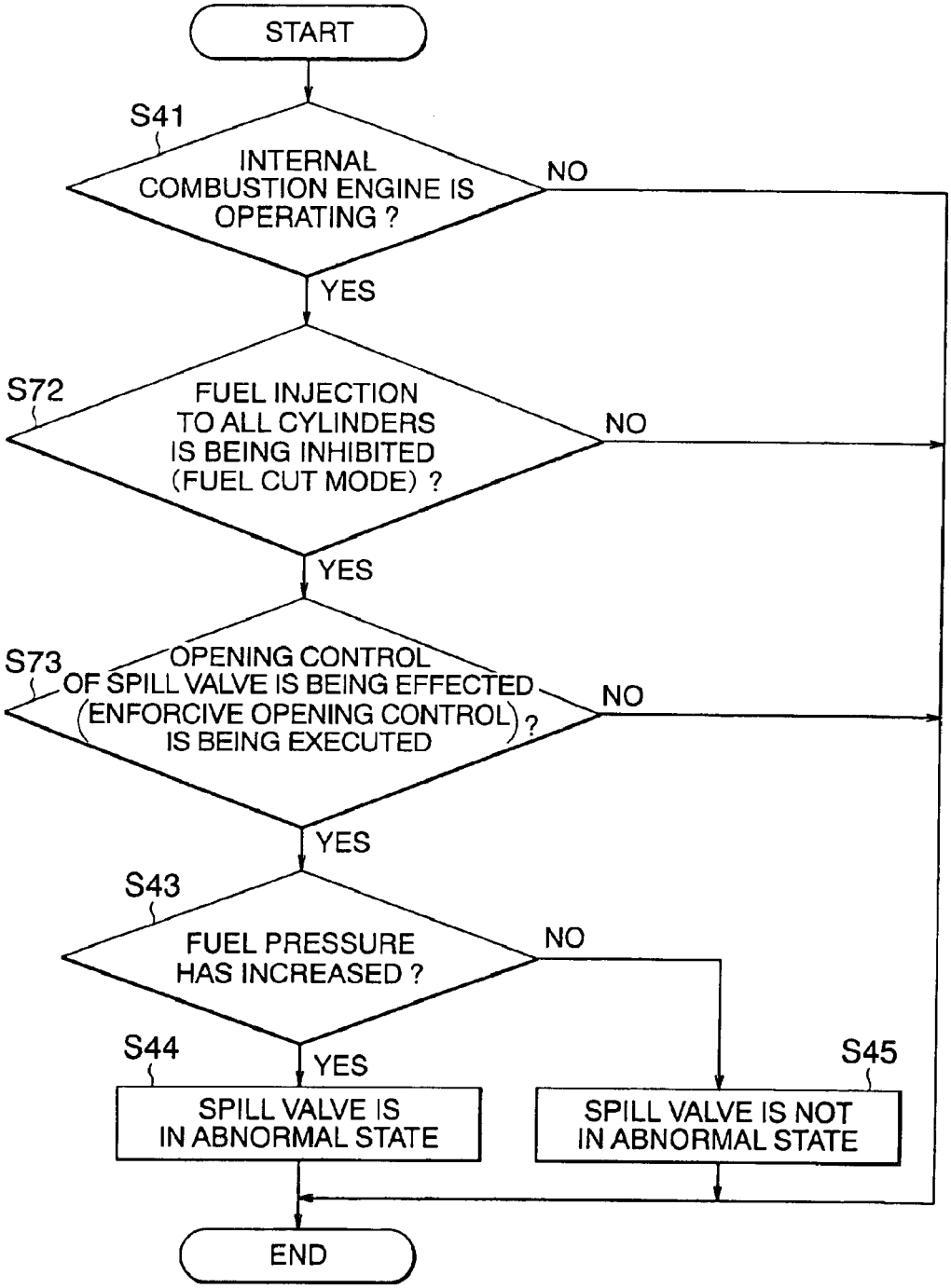
FIG. 7 is a flow chart for illustrating operation of an abnormality diagnosis apparatus for the high pressure fuel system of the cylinder injection type internal combustion engine according to the third embodiment of the invention.

FIG. 6 is a timing chart for illustrating the behavior of the fuel pressure PF during the period in which the fuel injection to all the cylinders is inhibited. Except that the fuel injection inhibit period (enforcive opening control interval for the spill valve 33) B is set, the contents of the timing chart shown in FIG. 6 are similar to those shown in FIG. 3.

In the abnormality diagnosis apparatus for the high pressure fuel system of the engine now under consideration, the ECU 30 incorporates therein a fuel injection inhibiting means for inhibiting the fuel injections for all the cylinders and a spill valve opening control means for performing an opening control of a fuel relief passage through which the spill valve communicates the pressure increasing chamber of the high pressure fuel pump to the low pressure side over the period or interval in which the fuel injection inhibiting means inhibits the fuel injection to all the cylinders.

Further, the abnormality decision enable period detecting means incorporated in the ECU 30 is designed to detect as the decision period (abnormality decision enable period) the period during which the fuel injection inhibiting means inhibits the fuel injection to all the cylinders while the spill valve opening control means effectuates the spill valve opening control.

Referring to FIG. 6, in the period or interval for inhibiting the fuel injection to all the cylinders, the level "1" indicates that the fuel injection is inhibited while the level "0" indicates that the fuel injection is enabled.

Further, during the period in which the ECU 30 issues the fuel injection inhibit command to the injectors 15 of all the cylinders, the spill valve opening control means incorporated in the ECU 30 forcibly opens the spill valve 33 to thereby inhibit the high pressure fuel pump 18 from supplying or feeding to the fuel rail 12 the fuel under pressure.

By the way, as the conditions for the fuel injection inhibit processing for all the cylinders, there may be mentioned the conditions that the throttle valve (not shown) for adjusting the quantity of air introduced into the internal combustion engine is fully closed and that the fuel cut mode in which the vehicle speed is being lowered is validated.

Referring to FIG. 6 illustrating the behavior of the fuel pressure PF prevailing within the fuel rail 12 in the course of operation of the internal combustion engine, it can be seen that when the valve opening/closing control of the spill valve 33 is in the closing control state, the fuel is fed under pressure to the fuel rail 12 from the high pressure fuel pump 18 with the fuel pressure PF increasing while the fuel pressure PF lowering during the fuel injection to the cylinder through the fuel injector 15.

Further, it can be seen that during the period in which neither the fuel feeding under pressure from the high pressure fuel pump 18 to the fuel rail 12 nor the fuel injection to the cylinders through the injectors 15 is performed, the fuel pressure PF remains constant.

Furthermore, it can be seen that during the period or interval B in which the fuel injection to all the cylinders through the fuel injectors 15 is inhibited and in which the fuel feeding under pressure to the fuel rail 12 by means of the high pressure fuel pump 18 is forcibly inhibited, the fuel pressure PF also remains constant.

As is obvious from the above, since the behavior of the fuel pressure PF remains constant over the period or interval B, increasing of the fuel pressure PF during this interval B means that the fuel is fed under pressure to the fuel rail 12 from the high pressure fuel pump 18, indicating occurrence of abnormal state.

In other words, the fact that nevertheless the command value issued by the ECU 30 indicates the opening control for the spill valve 33, the fuel pressure PF rises shows that an abnormal state is taking lace in which the spill valve 33 becomes unmovable at the closed position during the upward movement of the pump cam 17.

Next, referring to the flow chart shown in FIG. 7, description will be made of the abnormality diagnosis processing of the spill valve 33 in the abnormality diagnosis apparatus for the high pressure fuel system of the engine according to the third embodiment of the present invention.

In FIG. 7, the processing steps S41, S43 to S45 similar to those described hereinbefore by reference to FIG. 4 are omitted from description in detail.

Referring to FIG. 7, when it is decided in the step S41 that the engine is operating (i.e., when the decision step S41 is "YES"), then decision is made in a step S72 whether or not the fuel injection to all the cylinders is being inhibited (i.e., the fuel cut mode is being validated or not).

When it is decided in the step S72 that the fuel injection is not inhibited or disabled (i.e., when the step S72 is "NO"), the processing routine shown in FIG. 7 is immediately terminated, whereas when decision is made that the fuel injection is being inhibited (i.e., when the step S72 is "YES", then decision is made in succession as to whether or not the opening control of the spill valve 33 is being performed (i.e., whether or the enforcive opening control is being carried out) (step S73).

When it is decided in the step S73 that the enforcive opening control of the spill valve 33 is not being effectuated (i.e., when the step S73 is "NO"), the processing routine shown in FIG. 7 is immediately terminated, whereas when it is determined that the enforcive opening control of the spill valve 33 is being executed (i.e., when the step S73 is "YES"), decision is then made in succession as to whether or not the fuel pressure PF within the fuel rail 12 is rising (step S43).

Subsequently, when it is determined in the step S43 that the fuel pressure PF within the fuel rail 12 is rising (i.e., when the step S43 is "YES"), it is diagnostically determined that the spill valve 33 suffers abnormality (step S44) whereas unless the fuel pressure PF is rising (i.e., when the step S43 is "NO"), it can then be determined that the spill valve 33 suffers no abnormality (step S45).

In this way, the abnormality decision enable period detecting means incorporated in the ECU 30 is so designed as to detect as the abnormality decision enable period for which the fuel injection inhibiting means inhibits the fuel from being injected into all the cylinders and during which the opening control of the spill valve 33 is being carried out by the spill valve opening control means.

As is apparent from the above, the abnormality decision enable period of a relatively long time duration can be ensured, whereby the abnormality diagnosis of the spill valve 33 can be realized with high reliability (e.g. improved detection performance and enhanced insusceptibility to erroneous or false detection).

Embodiment 4

In the description of the abnormality diagnosis apparatus for the high pressure fuel system of the cylinder injection type internal combustion engine according to the first to third embodiments of the invention, no description has been made in the concrete concerning a decision reference in conjunction with the rising or increasing of the fuel pressure PF. In the abnormality diagnosis apparatus for the high pressure fuel system of the engine according to a fourth embodiment of the present invention, the fuel pressure detected by the abnormality decision enable period detecting means at the time point the abnormality decision enable period is started is set as a reference fuel pressure (decision reference) PFbase, as shown in FIG. 8.

In the following, the abnormality diagnosis processing for the spill valve 33 according to the fourth embodiment of the invention will be described in detail by reference to FIG. 8 together with FIGS. 1 and 2.

FIG. 8 is a flow chart for illustrating the abnormality diagnosis processing for the spill valve 33 according to the fourth embodiment of the present invention.

Concerning the processing steps shown in FIG. 8 which are similar to those described hereinbefore by reference to FIGS. 4, 5 and 7 (steps S41, S42, S44 and S45), repeated description in detail will be unnecessary.

Further, in the step S43A, decision processing as to whether or not the fuel pressure is rising is effected on the basis of the reference fuel pressure PFbase, and thus the step S43A naturally corresponds to the step S43 mentioned previously.

In the abnormality diagnosis apparatus for the high pressure fuel system of the cylinder direct injection type engine, the ECU 30 incorporates therein a fuel pressure storage means for storing the fuel pressure PF at the time point the decision period (abnormality decision enable period) is started, as detected by the abnormality decision enable period detecting means.

Further, in the ECU 30, the fuel pressure change arithmetic means is designed to arithmetically determine as the change of the fuel pressure whether the fuel pressure is in the rising (increasing) or lowering (decreasing) direction relative to the fuel pressure PF at the decision period starting time point (i.e., the reference fuel pressure PFbase) stored in the fuel pressure storage means during the abnormality decision enable period for the spill valve 33, while the abnormality diagnosing means is designed to decide or determine that the spill valve 33 suffers abnormality when the fuel pressure change occurs in the pressure rising direction.

Firstly, the ECU 30 makes decision as to whether or not the internal combustion engine is operating (step S41). When it is determined that the internal combustion engine is operating (i.e., when the step S41 is "YES"), then it is decided in succession in a step S82 whether or not it is the time point at which the abnormality decision enable period of the spill valve 33 starts (the time point falling within the fuel discharge period with the opening control of the spill valve 33 being effected).

In this conjunction, it is to be added that the time point immediately preceding or succeeding to the start of the abnormality decision enable period may be set as the starting time point for the abnormality decision enable period of the spill valve 33.

When decision is made in the step S82 that it is not the starting time point for the abnormality decision enable period (i.e., when the step S82 is "NO"), then the processing immediately proceeds to the step S42, whereas when the step S82 results in "YES", the fuel pressure PF at the starting time point for the abnormality decision enable period is stored in the storage means as the reference fuel pressure PFbase in a step S83, whereon the processing proceeds to the step S42.

Subsequently, when the fuel discharge period and the opening control of the spill valve 33 are determined in the step S42 (i.e., when the step S42 results in "YES"), decision is then made as to whether or not the fuel of high pressure is being injected into the cylinder by the injector 15 (step S53).

When it is determined in the step S53 that the fuel injection is not being effected (during the abnormality decision enable period) (i.e., when the step S53 results in "No"), decision is then made in the step S43A whether or not the fuel pressure PF prevailing within the fuel rail 12 has increased beyond the reference fuel pressure PFbase (the fuel pressure PF is rising).

In succession, when it is determined in the step S43A that PF>PFbase, the fuel pressure PF is rising (i.e., when the step S43A is "YES"), it is then determined diagnostically that the spill valve 33 suffers abnormality (step S44) whereas when PF≦PFbase (i.e., when the step S43A is "NO"), it is diagnosed that the spill valve 33 suffers no abnormality (step S45), whereupon the processing routine shown in FIG. 8 comes to an end.

In this way, by determining that the spill valve 33 suffers abnormality in the case where in the abnormality decision enable period, the fuel pressure change arithmetically determined by the fuel pressure change arithmetic means is in the increasing direction relative to the reference fuel pressure PFbase at the starting time point of the abnormality decision enable period stored in the fuel pressure storage means, the abnormality diagnosis of the spill valve can be realized with higher reliability (e.g. much improved detection performance and higher insusceptibility to erroneous or false detection).

Embodiment 5

In the case of the abnormality diagnosis apparatus for the high pressure fuel system of the cylinder injection type engine according to the fourth embodiment of the invention, such arrangement is adopted that when the fuel pressure PF has increased beyond the reference fuel pressure (decision reference) PFbase, it is determined that the fuel pressure PF is rising or increasing. In the abnormality diagnosis apparatus for the high pressure fuel system of the cylinder injection type engine according to a fifth embodiment of the present invention, determination of the fuel pressure PF as to whether it is rising or not is made on the basis of an increment of the fuel pressure PF relative to the reference fuel pressure PFbase (i.e., an amount by which the fuel pressure PF increases relative to the reference fuel pressure PFbase), as shown in FIG. 9.

In the following, the abnormality diagnosis processing for the spill valve 33 according to the fifth embodiment of the invention will be described in detail by reference to FIG. 9 together with FIGS. 1 and 2.

FIG. 9 is a flow chart for illustrating the abnormality diagnosis processing for the spill valve 33 according to the teaching of the present invention incarnated in the fifth embodiment thereof. In FIG. 9, the processings except for that in the step S43B are similar to those described previously in conjunction with FIG. 8.

In the step S43B, the processing for deciding whether or not the fuel pressure is rising or increasing on the basis of the reference fuel pressure PFbase is executed. This step 43B corresponds to the step S43A described previously.

In the abnormality diagnosis apparatus now under consideration, the fuel pressure change arithmetic means incorporated in the ECU 30 is designed to arithmetically determine as the change of the fuel pressure the fuel pressure increment (=PF−PFbase) relative to the fuel pressure PF at the starting time point of the abnormality decision enable period (i.e., the reference fuel pressure PFbase) stored in the fuel pressure storage means in the decision period, while the abnormality diagnosing means is designed to determine that the spill valve 33 suffers abnormality when the change of the fuel pressure indicates that the fuel pressure has changed by a predetermined pressure increment value PFup or more in the pressure rising direction.

Firstly, when it is determined in the step S41 that the internal combustion engine is operating (i.e., when "YES" in the step S41) and when determination is made in the step S82 that it is the starting time point of the abnormality decision enable period for the spill valve 33 (i.e., when "YES" is the step S82), the ECU 30 stores the fuel pressure PF at the starting time point of the abnormality decision enable period as the reference fuel pressure PFbase.

In succession, when determination is made in the step S42 that the fuel discharge period is validated and that the spill valve 33 is undergoing the valve opening control (i.e., when "YES" in the step S42) and when it is determined in a step S53 that the fuel of high pressure is not being injected through the fuel injector 15 (i.e., when "NO" in the step S53), it is regarded that the abnormality decision enable period is validated, whereon the processing proceeds to the step S43B.

In the step S43B, the ECU 30 makes decision whether or not the fuel pressure PF prevailing within the fuel rail 12 in the abnormality decision enable period has increased by the predetermined pressure increment value PFup or more relative to the reference fuel pressure PFbase, to thereby determine whether the fuel pressure PF is rising or not.

At this juncture, it should be added that the predetermined pressure increment value PFup is to be set to a pressure value which exceeds the range of variance or dispersion of the behavior of the fuel pressure PF (inclusive of that of the output behavior or characteristic of the fuel pressure sensor 19) with a view to positively excluding erroneous or false diagnosis which may otherwise be brought about by dispersion or variance of the behavior of the fuel pressure PF.

Subsequently, when it is determined in the step S43B that the fuel pressure PF is rising or increasing and thus PF−PFbase≦PFup (i.e., when "YES" in the step S43B), it is diagnostically determined that the spill valve 33 is in the abnormal state (step S44). On the contrary, in the case where the fuel pressure PF is not increasing and where PF−PFbase<PFup (i.e., "NO" in the step S44), it is diagnostically determined that the spill valve 33 suffers no abnormal state (step S45). The processing routine shown in FIG. 9 then comes to an end.

As is apparent from the above, in the case where the abnormality decision enable period is validated and where change of the fuel pressure arithmetically determined by the fuel pressure change arithmetic means indicates that the fuel pressure has changed in the pressure rising direction by the predetermined pressure increment value PFup beyond the reference fuel pressure PFbase (i.e., the fuel pressure PF at the starting time point of the abnormality decision enable period stored in the fuel pressure storage means), determination can be made that the spill valve 33 is in the abnormal state. In this manner, further enhanced reliability can be ensured for the abnormality diagnosis for the spill valve 33 because the erroneous or false diagnosis due to dispersion or variance of the behavior of the fuel pressure PF (inclusive of variance of the fuel pressure sensor 19) can be excluded more positively.

Embodiment 6

In the case of the abnormality diagnosis apparatus for the high pressure fuel system according to the fourth and fifth embodiments of the invention, such arrangement is adopted that it is determined that the fuel pressure PF is rising or increasing by making use of the reference fuel pressure PFbase at the starting time point in the abnormality decision enable period. In the abnormality diagnosis apparatus for the high pressure fuel system of the cylinder injection type internal combustion engine according to a sixth embodiment of the present invention, a fuel pressure increasing rate within a unitary time t[sec] is computed to thereby diagnostically determine whether the fuel pressure PF is increasing or not on the basis of the fuel pressure increasing rate, as shown in FIG. 10.

In the following, the abnormality diagnosis processing for the spill valve 33 according to the sixth embodiment of the invention will be described in detail by reference to FIG. 10 together with FIGS. 1 and 2.

Figure 10:
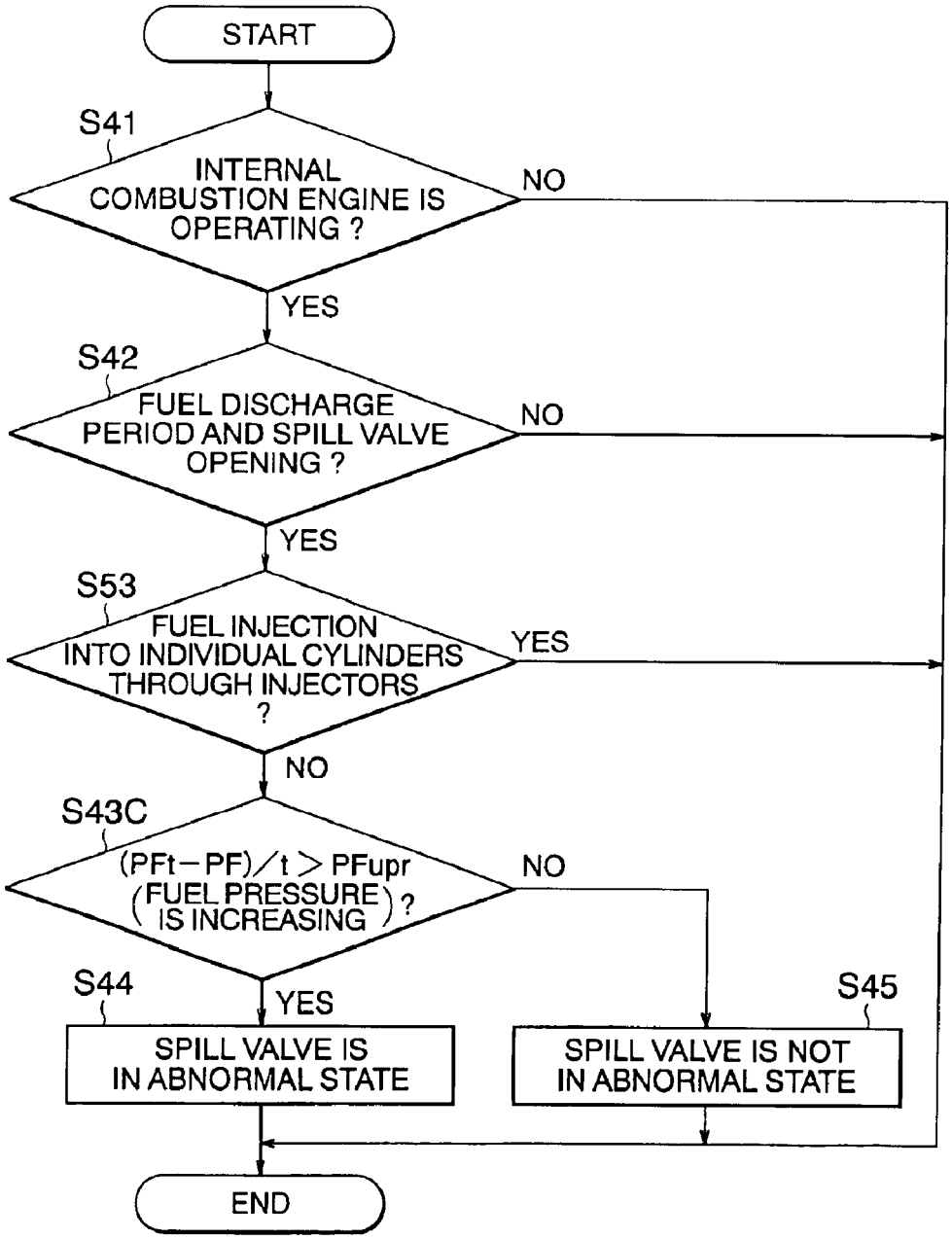
FIG. 10 is a flow chart for illustrating operation of an abnormality diagnosis apparatus for a high pressure fuel system of a cylinder injection type engine according to a sixth embodiment of the present invention.

FIG. 10 is a flow chart for illustrating the abnormality diagnosis processing for the spill valve 33 according to the teaching of the present invention incarnated in the sixth embodiment thereof. In FIG. 10, the processings other than that in the step S43C are similar to those described previously in conjunction with FIG. 5.

In the step S43C, the processing for deciding whether or not the fuel pressure is rising or increasing on the basis of the fuel pressure increasing rate PFrate (=(PFt−PF)/t). This step 43C corresponds to the step S43 (or alternatively steps S43A or S43B) mentioned previously.

At this juncture, it should be added that in the ECU 30, the fuel pressure change arithmetic means incorporated in the ECU 30 is so designed as to arithmetically determine as the change of the fuel pressure the fuel pressure increasing rate PFrate per unitary time t[sec] (i.e., (PFt−PF)/t), while the abnormality diagnosing means is so designed as to determine that the spill valve 33 is in the abnormal state when the change of the fuel pressure (i.e., fuel pressure increasing rate PFrate) is not smaller than a predetermined increasing rate PFupr.

Firstly, when it is determined in the step S41 that the internal combustion engine is operating (i.e., when "YES" in the step S41) and when determination is made in the step S42 that the fuel discharge period is validated and that the spill valve 33 is undergoing the valve opening control (i.e., when "YES" in the step S42) and when it is determined in a step S53 that the fuel of high pressure is not being injected through the fuel injector 15 (i.e., when "NO" in the step S53), it is regarded that the abnormality decision enable period is validated, whereupon the processing proceeds to the step S43C.

In the step S43C, the ECU 30 makes decision as to whether the fuel pressure PF prevailing within the fuel rail 12 during the abnormality decision enable period is increasing or not on the basis of the fact that whether or not the fuel pressure increasing rate PFrate per the unitary time t[sec] is greater than the predetermined increasing rate PFupr.

At this juncture, it should be added that the fuel pressure increasing rate PFrate in the state where abnormality takes place in the spill valve 33 is equivalent to the total discharge state in which all the fuel introduced into the high pressure fuel pump 18 is fed under pressure to the fuel rail 12 and thus assumes a maximum value. Consequently, the fuel pressure increasing rate PFrate is set to a value suited for detecting the fuel pressure increasing rate PFrate of the maximum value mentioned above while excluding the erroneous or false diagnosis ascribable to dispersion or variance of the fuel pressure PF (inclusive of variance of the output characteristic of the fuel pressure sensor 19).

Incidentally, the unitary time t[sec] mentioned previously corresponds to the arithmetic operation period (processing period) of the fuel pressure increasing rate PFrate.

Further, the fuel pressure increasing rate PFrate can be given by the undermentioned expression (1) on the basis of the fuel pressure PFt before the unitary time t[sec] and the fuel pressure PF at the instant or current time point.

$$PFrate=(PFt-PF)/t \quad (1)$$

Subsequently, when it is determined in the step S43C that the fuel pressure PF is rising or increasing and that PFrate> PFupr≧ PFup (i.e., when "YES" in the step S43C), it is then diagnostically determined that the spill valve 33 is in the abnormal state (step S44). On the contrary, in the case where the fuel pressure PF is not increasing and where PFrate≦PFupr (i.e., "NO" in the step S44), it is diagnosed that the spill valve 33 suffers no abnormality (step S45), whereupon the processing routine shown in FIG. 10 comes to an end.

As is apparent from the above, in the abnormality diagnosis apparatus for the high pressure fuel system of the cylinder injection type engine according to the sixth embodiment of the invention, decision as to whether or not the fuel pressure PF within the fuel rail 12 is rising or increasing can be realized by making decision whether or not the fuel pressure increasing rate PFrate per unitary time t (see the expression (1)) is greater than the predetermined increasing rate PFupr, wherein abnormality state of the spill valve 33 is determined during the period in which the fuel pressure increasing rate PFrate becomes maximum. By virtue of this feature, the abnormality diagnosis of the spill valve 33 can be realized with further enhanced reliability.

Embodiment 7

In the abnormality diagnosis apparatuses for the high pressure fuel system of the cylinder injection type engine according to the first to six embodiments of the invention, no description has been made concerning the time point or timing at which the arithmetic determination of the change of the fuel pressure by the fuel pressure change arithmetic means is started (hereinafter referred to as the fuel pressure change arithmetic starting time point). By contrast, in the abnormality diagnosis apparatus for the high pressure fuel system of the cylinder injection type engine according to a seventh embodiment of the present invention, the fuel pressure change arithmetic starting time point determined by the fuel pressure change arithmetic means is preset at a time point after lapse of a predetermined time Ccnst since the start of the abnormality decision enable period, as is shown in FIG. 11.

In the following, the abnormality diagnosis processing for the spill valve 33 according to the seventh embodiment of the invention will be described in detail by reference to FIG. 11 together with FIGS. 1 and 2.

Figure 11:
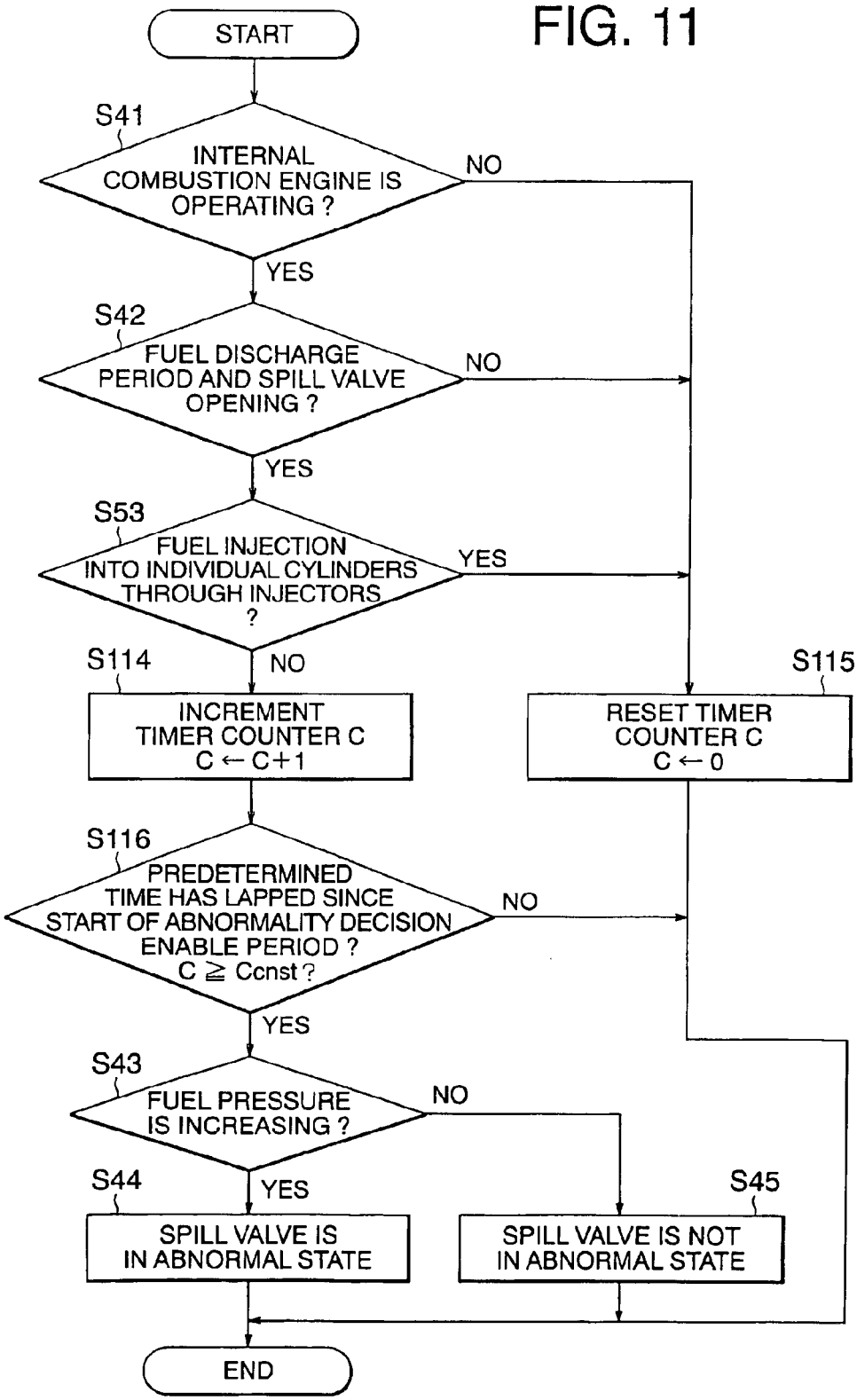
FIG. 11 is a flow chart for illustrating operation of an abnormality diagnosis apparatus for a high pressure fuel system of a cylinder injection type engine according to a seventh embodiment of the present invention.

FIG. 11 is a flow chart for illustrating the abnormality diagnosis processing for the spill valve 33 according to the teaching of the present invention incarnated in the seventh embodiment thereof. In FIG. 11, the processings except that processing steps S114 to S116 are additionally inserted are similar to those described previously by reference to FIG. 5.

In the abnormality diagnosis apparatus for the high pressure fuel system now under consideration, the fuel pressure change arithmetic means incorporated in the ECU 30 includes a timer counter C which is incremented after the start of the abnormality decision enable period for starting operation of arithmetically determining the change of the fuel pressure (i.e., abnormality diagnosis for the spill valve 33) after lapse of the predetermined time Ccnst since the start of the abnormality decision enable period.

In other words, after validation of the abnormality decision enable period in the operating state of the internal combustion engine (i.e., in the fuel discharge period and during the opening control of the spill valve 33), the abnormality diagnosis for the spill valve 33 is inhibited until the predetermined time Ccnst has elapsed.

Firstly, when it is determined in the step S41 that the internal combustion engine is operating (i.e., when "YES" in the step S41) and when determination is made in the step S42 that the fuel discharge period is validated and that the spill valve 33 is undergoing the valve opening control (i.e., when "YES" in the step S42) and when it is determined in a step S53 that the fuel of high pressure is not being injected through the fuel injector 15 (i.e., when "NO" in the step S53), it is regarded that the abnormality decision enable period is validated, whereon the processing proceeds to a step S114.

On the other hand, when it is determined in the step S41 that the internal combustion engine is not operating (i.e., when "NO" in the step S41), it is regarded that the abnormality decision enable period is not being validated, whereupon the processing proceeds to a step S115.

Further, when it is determined in the step S42 that the fuel discharge period is not validated or the spill valve 33 is not undergoing the opening control (i.e., when the step S42 results in "NO"), then the abnormality decision enable period is regarded as not being validated, whereupon the processing proceeds to the step S115.

Similarly, when it is determined in the step S53 that the fuel of high pressure is being injected into the individual cylinders through the respective fuel injectors (i.e., when the step S53 results in "YES"), the abnormality decision enable period is regarded as not being validated, whereon the processing proceeds to the S115.

In this way, so long as the abnormality decision enable period has not been validated, the ECU 30 resets (clears to zero) the timer counter C put into operation upon starting of the abnormality decision enable period in the step S115, whereon the processing routine shown in FIG. 11 comes to an end.

On the other hand, when the abnormality decision enable period is started, the ECU 30 increments the timer counter C which is designed to operate after the start of the abnormality decision enable period in the step S114.

In succession, it is checked whether or not the count value of the timer counter C shows that the predetermined time Ccnst or more has lapsed since the start of the abnormality decision enable period (step S116). When it is determined that C<Ccnst (i.e., when "NO" in the step S116), then the processing routine shown in FIG. 11 is immediately terminated.

At this juncture, it is noted that in the case where the abnormality decision enable period is validated, e.g. when the fuel pressure PF is increasing, there may occur such period during which the fuel pressure PF rises or increases under inertia in dependence on the timing at which the abnormality decision enable period is validated. For the purpose of excluding such fuel pressure rising period attributable to the inertia, the predetermined time Ccnst is set sufficiently long.

On the other hand, when it is decided in the step S116 that C≦ Ccnst (i.e., "YES" in the step S116), the processing proceeds to the step (step S43) for the decision processing validated during the increasing of the fuel pressure PF.

Subsequently, when it is determined in the step S43 that the fuel pressure PF is rising or increasing (i.e., when "YES" in the step S43), it is diagnostically determined that the spill valve 33 is abnormal (step S44). On the contrary, in the case where the fuel pressure is not increasing (i.e., "NO" in the step S44), it is diagnosed that the spill valve 33 suffers no abnormality (step S45), whereupon the processing routine shown in FIG. 11 comes to an end.

As is apparent from the above, by setting the time point for storing the operation for arithmetically determining the change of the fuel pressure with the fuel pressure change arithmetic means at the time point at which the predetermined time Ccnst has lapsed since the starting of the abnormality decision enable period, such period during which the fuel pressure rise occurs under inertia, for example, when the abnormality decision enable period is validated, whereby the fuel pressure increasing can positively be excluded. Thus, the abnormality diagnosis of the spill valve 33 can be realized with further enhanced reliability.

Embodiment 8

In the case of the abnormality diagnosis apparatuses for the high pressure fuel system according to the first to seventh embodiments of the invention described above, no consideration is paid to the engine rotation speed (rpm) Ne of the internal combustion engine as the condition for executing the abnormality diagnosis processing of the spill valve 33 (i.e., the condition for setting the abnormality decision enable period). In the abnormality diagnosis apparatus for the high pressure fuel system according to an eighth embodiment of the present invention, the engine rotation speed (rpm) Ne is additionally taken into account as the condition for executing the abnormality diagnosis processing.

In the following, the abnormality diagnosis processing for the spill valve 33 according to the eighth embodiment of the invention will be described in detail by reference to FIG. 12 together with FIGS. 1 and 2.

Figure 12:
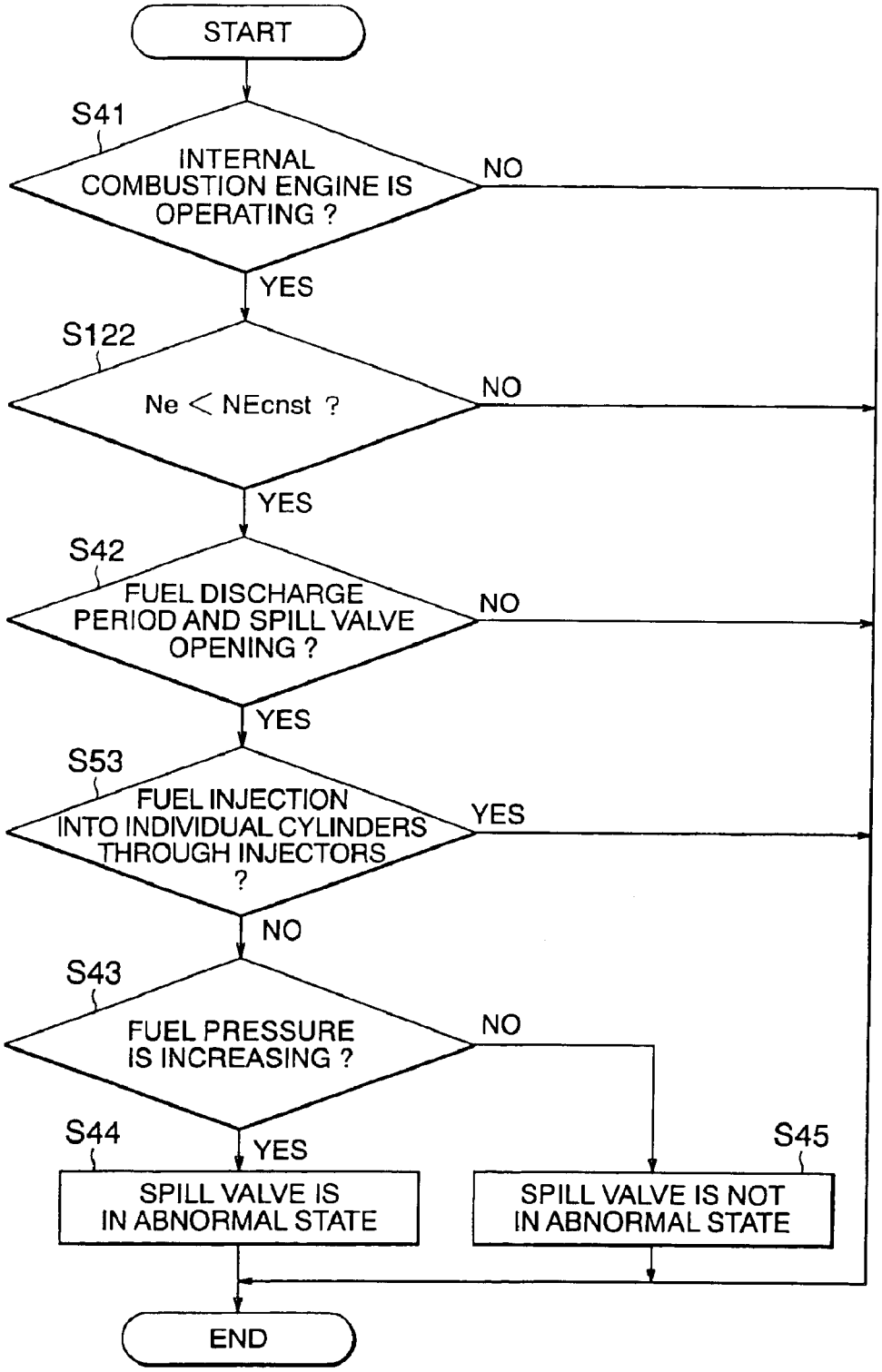
FIG. 12 is a flow chart for illustrating operation of an abnormality diagnosis apparatus for a high pressure fuel system of a cylinder injection type engine according to an eighth embodiment of the present invention.

FIG. 12 is a flow chart for illustrating the abnormality diagnosis processing for the spill valve 33 according to the teaching of the present invention incarnated in the eighth embodiment thereof. In FIG. 12, the processings are similar to those described previously in conjunction with FIG. 5 except that a processing step S122 is additionally inserted.

In the abnormality diagnosis apparatus for the high pressure fuel system now under consideration, the ECU 30 incorporates therein a rotation speed arithmetic means for arithmetically determining the engine rotation speed (rpm) Ne of the internal combustion engine on the basis of the pulse signal derived from the output of the crank angle sensor 13.

Further, as the condition for allowing the abnormality diagnosis processing to be executed by the abnormality diagnosing means incorporated in the ECU 30 (i.e., the condition for setting the abnormality decision enabling period), such condition that the engine rotation speed (rpm) Ne be lower than a predetermined rotation speed (rpm) NEcnst is additionally preset so that when the engine rotation speed (rpm) Ne is higher than the predetermined rotation speed (rpm) NEcnst inclusive, execution of the abnormality decision processing for the spill valve 33 is stopped.

More specifically, when it is determined in the step S41 that the internal combustion engine is operating (i.e., when "YES" in the step S41), the ECU 30 makes decision whether or not the engine rotation speed (rpm) Ne of the internal combustion engine is lower than the predetermined rotation speed (rpm) NEcnst in a step S122.

At this juncture, it should be added that the predetermined rotation speed (rpm) NEcnst is set to a value which is sufficient for excluding such a state in which a part of the fuel is fed under pressure to the fuel rail 12 because of impossibility of relieving or spilling a sufficient amount of fuel from the fuel relief passage due to increasing of the engine rotation speed (rpm) Ne of the internal combustion engine during stopping of the fuel feeding under pressure to the fuel rail 12 from the high pressure fuel pump 18 (i.e., during opening of the fuel relief passage by the opening control of the spill valve 33).

When it is determined in the step S122 that Ne≧NEcnst (i.e., when "NO" in the step S122), the abnormality diagnosis processing for the spill valve 33 is immediately stopped, whereupon the processing routine shown in FIG. 12 is immediately terminated.

On the other hand, when it is determined in the step S122 that Ne<NEcnst (i.e., when "YES" in the step S122), the abnormality decision enable period determination processing and the abnormality diagnosis processing succeeding to the step S42 are executed.

At this juncture, it should be added that when the engine rotation speed (rpm) Ne is higher than the predetermined rotation speed (rpm) NEcnst inclusive of the latter, the abnormality diagnosis processing for the spill valve 33 is inhibited. Thus, it is possible to exclude such a state in which a part of the fuel is fed under pressure to the fuel rail 12 because of impossibility of relieving or spilling a sufficient amount of fuel from the fuel relief passage due to increasing of the rotation during inhibition of the fuel feeding under pressure to the fuel rail 12 from the high pressure fuel pump 18 (i.e., during opening of the fuel relief passage by the opening control of the spill valve 33).

Embodiment 9

In the abnormality diagnosis apparatuses for the high pressure fuel system according to the first to eighth embodiments of the invention described above, no description has been made concerning a fail-safe processing after the abnormality diagnosis of the spill valve 33. In the abnormality diagnosis apparatus for the high pressure fuel system according to a ninth embodiment of the present invention, a fail-safe processing (step S136) is executed when the abnormal state of the spill valve 33 has diagnostically been determined, as is shown in FIG. 13.

In the following, the abnormality diagnosis processing for the spill valve 33 according to the ninth embodiment of the invention will be described in detail by reference to FIG. 13 together with FIGS. 1 and 2.

Figure 13:
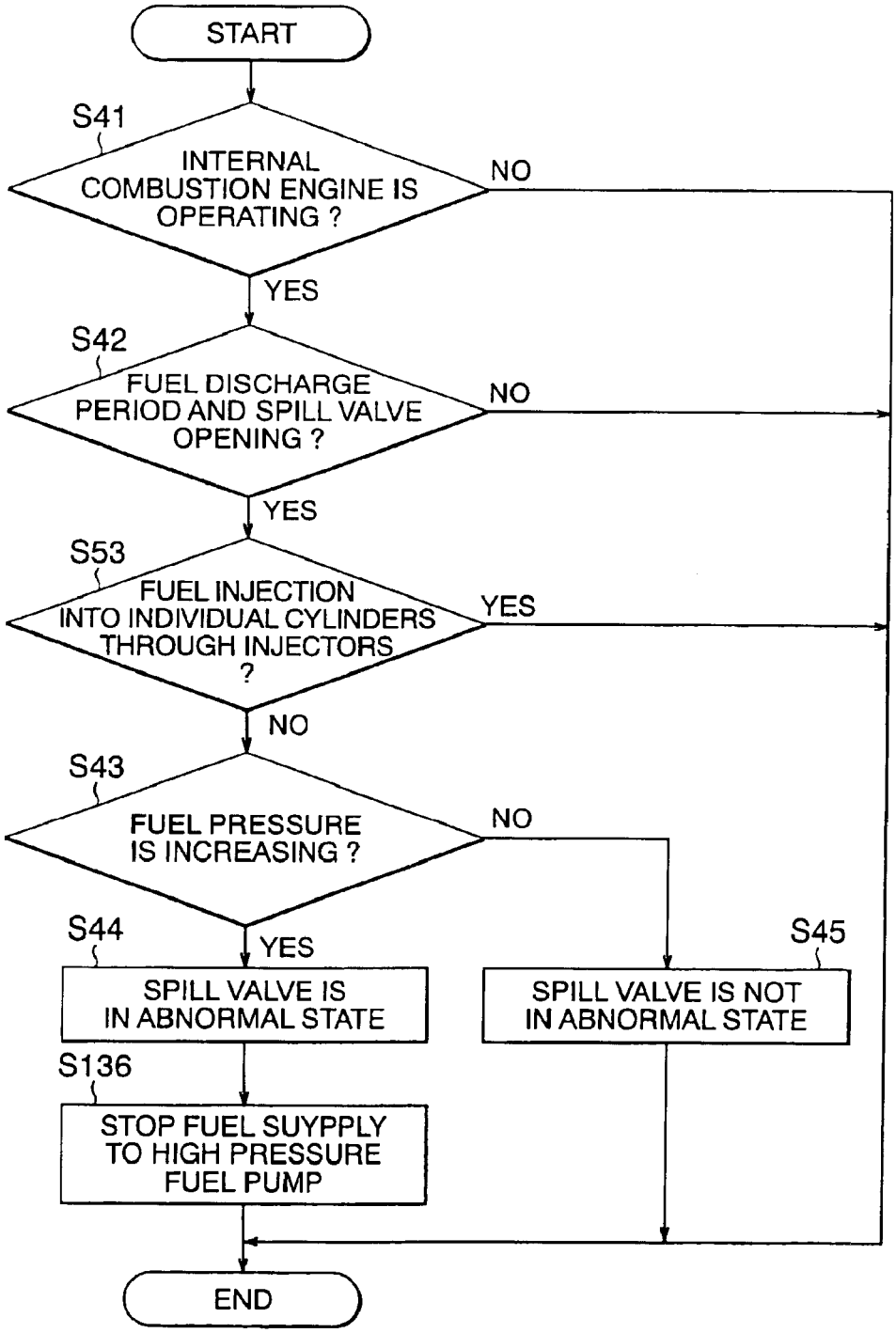
FIG. 13 is a flow chart for illustrating operation of an abnormality diagnosis apparatus for a high pressure fuel system of a cylinder injection type engine according to a ninth embodiment of the present invention.

FIG. 13 is a flow chart for illustrating the abnormality diagnosis processing for the spill valve 33 according to the teaching of the present invention incarnated in the ninth embodiment thereof. In FIG. 13, the processings illustrated therein are substantially similar to those described hereinbefore by reference to FIG. 5 except that the fail-safe processing (i.e., processing of stopping the fuel feeding to the high pressure fuel pump 18) is additionally inserted in a step S136.

In the abnormality diagnosis apparatus for the high pressure fuel system under consideration, the ECU 30 incorporates therein a fuel intake control means for controlling the intake of the fuel to the high pressure fuel pump 18, wherein when abnormality of the spill valve 33 is diagnostically determined by the abnormality diagnosing means, the fuel intake control means stops the fuel intake processing to the high pressure fuel pump 18.

More specifically, when the conditions for the abnormality decision enable period are verified in the steps S41, S42 and S53 and when the abnormal state of the spill valve 33 has diagnostically been determined in the steps S43 and S44, the fuel feeding to the high pressure fuel pump 18 is stopped in the step S136, whereupon the processing routine shown in FIG. 13 comes to an end.

As is apparent from the above, by inhibiting the fuel feeding to the high pressure fuel pump 18 when the spill valve 33 suffers abnormality, it can be avoided that the fuel pressure prevailing within the fuel rail 12 becomes abnormally high and it is possible to prevent the fuel leakage in accompanying with the damage of the fuel rail 12. Thus, the fail-safe function can be realized upon occurrence of abnormality.

Embodiment 10

In connection with the ninth embodiment of the invention described above, no description has been made in the concrete of the method of stopping the fuel feeding to the high pressure fuel pump 18 upon occurrence of abnormality in the spill valve 33. In the abnormality diagnosis apparatus for the high pressure fuel system of the cylinder injection type engine according to a tenth embodiment of the present invention, the method of stopping the fuel feeding is realized by stopping operation of the feed pump 21, as shown in FIG. 14.

In the following, the abnormality diagnosis processing for the spill valve 33 according to the tenth embodiment of the invention will be described in detail by reference to FIG. 14 together with FIGS. 1 and 2.

Figure 14:
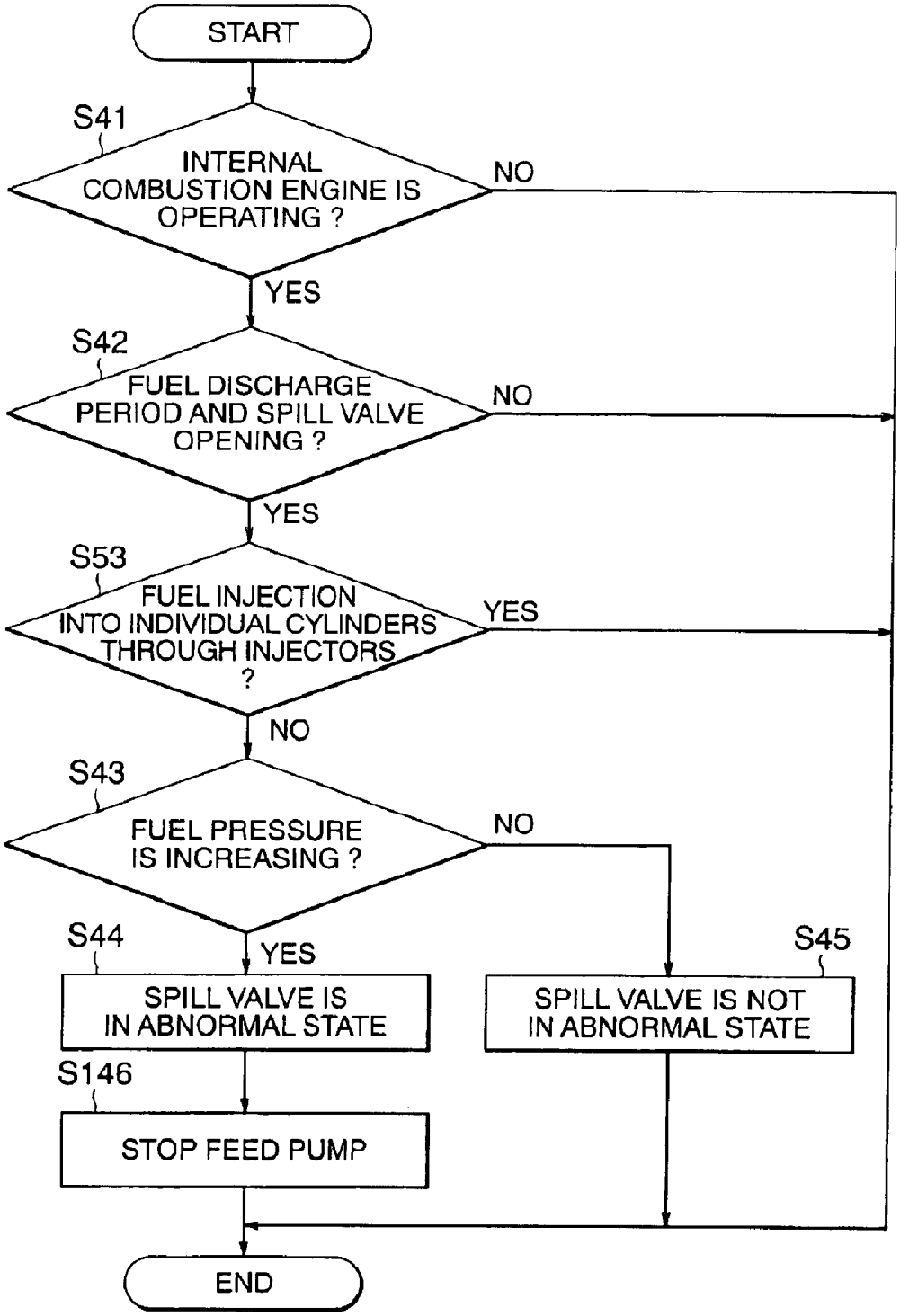
FIG. 14 is a flow chart for illustrating operation of an abnormality diagnosis apparatus for a high pressure fuel system of a cylinder injection type engine according to a tenth embodiment of the present invention.

FIG. 14 is a flow chart for illustrating the abnormality diagnosis processing for the spill valve 33 according to the tenth embodiment of the present invention. In FIG. 14, the steps S41 to S45 are similar to those described previously by reference to FIG. 13. Further, a step S146 corresponds to the step S136 mentioned hereinbefore.

In the abnormality diagnosis apparatus for the high pressure fuel system of the cylinder injection type internal combustion engine now concerned, the fuel intake control means incorporated in the ECU 30 cooperates with the feed pump 21 for pumping up the fuel from the fuel tank 20 to feed the fuel to the high pressure fuel pump 18, whereby when it is diagnostically determined by the abnormality diagnosing means that the spill valve 33 suffers abnormality, operation of the feed pump 21 is stopped.

More specifically, when the conditions for the abnormality decision enable period are validated in the steps S41, S42 and S53 and when the abnormal state of the spill valve 33 has diagnostically been determined in the steps S43 and S44, the feed pump 21 is stopped, as a result of which the fuel feeding to the high pressure fuel pump 18 in the step S146 stopped, whereupon the processing routine shown in FIG. 14 comes to an end.

As is apparent from the above, when the spill valve 33 suffers abnormality, the fuel feeding to the high pressure fuel pump 18 can positively be inhibited by stopping the feed pump 21.

As a result of this, not only abnormally high fuel pressure within the fuel rail 12 but also fuel leakage because of damage of the fuel rail 12 can be prevented, which can realize the fail-safe function upon occurrence of abnormality.

The teachings of the present invention disclosed herein can find application for coping with any one of the physical/mechanical blockage abnormalities in which the spill valve 33 is stationarily fixed physically at the closed position due to admixture of foreign material(s) admixed into the fuel, the abnormality in which the spill valve 33 remains at the closed position notwithstanding of the fact that the spill valve 33 is undergoing the opening control during the fuel discharge period of the high pressure fuel pump 18, and the electrical blockage abnormality in which the spill valve is fixedly secured at the closed position due to electric factors such as the wire breaking and short circuit of the spill valve 33.

Many features and advantages of the present invention are apparent from the detailed description and thus it is intended by the appended claims to cover all such features and advantages of the apparatus which fall within the spirit and scope of the invention. Further, since numerous modifications and changes will readily occur to those skilled in the art, it is not desired to limit the invention to the exact construction and operation illustrated and described.

By way of example, in the abnormality diagnosis apparatuses for the high pressure fuel system according to the first to tenth embodiments, it has been presumed that the intake passage and the relief passage for the fuel are provided separately or individually. However, it is equally possible to apply the teachings of the present invention to the abnormality diagnosis apparatus for the high pressure fuel system where the high pressure fuel pump is employed in which the intake passage and the relief passage are provided integrally (i.e., in which the spill valve 33 can be opened/closed by means of a plunger rod).

Further, although the present invention has been described in conjunction with the first to tenth embodiments for the cylinder injection/spark ignition type gasoline engine (refer to FIG. 1), it goes without saying that the present invention is never restricted thereto. The invention can equally be applied to other engines equipped with similar high pressure fuel injection system (e.g. compression-firing type Diesel engine or the like) as well.

Accordingly, all suitable modifications and equivalents may be resorted to, falling within the scope of the invention.

What is claimed is:

1. An abnormality diagnosis apparatus for a high pressure fuel system of a cylinder injection type internal combustion engine, comprising:

an accumulator for storing a fuel in a high pressure state;

a high pressure fuel pump for taking in the fuel supplied from a fuel tank to thereby feed under pressure said fuel to said accumulator;

a spill valve for opening/closing a fuel relief passage which communicates a pressure increasing chamber of said high pressure fuel pump to a low pressure side thereof;

injectors for supplying directly through injection into individual cylinders of said internal combustion engine the fuel of high pressure stored in said accumulator;

a fuel pressure sensor for detecting as a fuel pressure the pressure of the fuel supplied to said injector; and fuel pressure control means for variably setting a target value of said fuel pressure while setting said fuel pressure to said target value, wherein a control period of said high pressure fuel pump validated by means of said fuel pressure control means includes a fuel intake period for taking in the fuel and a fuel discharge period for discharging the fuel, said fuel discharge period including a spill valve closing control period for close-controlling said spill valve for feeding the fuel under pressure to said accumulator from said pressure increasing chamber, and a spill valve opening control period for open-controlling said spill valve for releasing the fuel to said low pressure side from said pressure increasing chamber, and wherein said fuel pressure control means includes spill valve control period setting means for adjusting said spill valve closing control period and said spill valve opening control period;

abnormality decision enable period detecting means for detecting as an abnormality decision enable period said spill valve opening control period with falls within said fuel discharge period in the course of operation of said internal combustion engine;

fuel pressure change arithmetic means for arithmetically determining change of said fuel pressure on the basis of said abnormality decision enable period; and abnormality diagnosing means for making decision as to abnormality of said spill valve on the basis of the change of said fuel pressure.

2. An abnormality diagnosis apparatus for a high pressure fuel system of a cylinder injection type internal combustion engine according to claim 1, wherein said abnormality decision enable period detecting means is so designed as to detect as said abnormality decision enable period the spill valve opening control period during which said spill valve is opened to allow the fuel to be spilled to the low pressure side from said pressure increasing chamber of said high pressure fuel pump and a period during which the fuel injection into said cylinder through said injector is not carried out.

3. An abnormality diagnosis apparatus for a high pressure fuel system of a cylinder injection type internal combustion engine according to claim 1, further comprising:

fuel injection inhibiting means for inhibiting the fuel injections for all the cylinders; and spill valve opening control means for performing an opening control of said fuel relief passage by said spill valve during the period in which said fuel injection inhibiting means inhibits the fuel injection to all of said cylinders, wherein said abnormality decision enable period detecting means is designed to detect as said abnormality decision enable period a period during which said fuel injection inhibiting means inhibits the fuel injection to all of said cylinders while said spill valve opening control means opens said spill valve.

4. An abnormality diagnosis apparatus for a high pressure fuel system of a cylinder injection type internal combustion engine according to claim 1, further comprising:

fuel pressure storage means for storing the fuel pressure at the time point the abnormality decision enable period is started, as detected by said abnormality decision enable period detecting means, wherein said fuel pressure change arithmetic means is designed to arithmetically determine as said change of said fuel pressure change of the fuel pressure in the increasing direction relative to the fuel pressure at said abnormality decision enable period starting time point stored in said fuel pressure storage means during said abnormality decision enable period, while said abnormality diagnosing means is designed to decide that said spill valve suffers abnormality when said fuel pressure change takes place in said pressure increasing direction.

5. An abnormality diagnosis apparatus for a high pressure fuel system of a cylinder injection type internal combustion engine according to claim 1, further comprising:

fuel pressure storage means for storing the fuel pressure at the time point the abnormality decision enable period is started, as detected by said abnormality decision enable period detecting means, wherein said fuel pressure change arithmetic means is designed to arithmetically determine as the change of said fuel pressure a fuel pressure increment relative to the fuel pressure at the starting time point of said abnormality decision enable period which is stored in said fuel pressure storage means during said abnormality decision enable period, and wherein said abnormality diagnosing means is designed to determine that said spill valve suffers abnormality when said change of said fuel pressure indicates that said fuel pressure has changed by a predetermined pressure increment value or more in the pressure increasing direction.

6. An abnormality diagnosis apparatus for a high pressure fuel system of a cylinder injection type internal combustion engine according to claim 1, wherein said fuel pressure change arithmetic means is so designed as to arithmetically determine as said change of said fuel pressure a fuel pressure increasing rate per unitary time t[sec] detected by said abnormality decision enabling period detecting means, and wherein said abnormality diagnosing means is so designed as to determine that said spill valve suffers abnormality when said change of said fuel pressure is not smaller than a predetermined increasing rate.

7. An abnormality diagnosis apparatus for a high pressure fuel system of a cylinder injection type internal combustion engine according to claim 1, wherein said fuel pressure change arithmetic means is so designed as to start operation for arithmetically determining the change of said fuel pressure after lapse of a predetermined time since the start of the abnormality decision enable period as detected by said abnormality decision enable period detecting means.

8. An abnormality diagnosis apparatus for a high pressure fuel system of a cylinder injection type internal combustion engine according to claim 1, further comprising:

rotation speed arithmetic means for arithmetically determining an engine rotation speed (rpm) of said internal combustion engine, wherein said abnormality diagnosing means is so designed as to stop execution of the abnormality decision processing for said spill valve when said engine rotation speed (rpm) of said internal combustion engine is higher than a predetermined rotation speed (rpm) inclusive.

9. An abnormality diagnosis apparatus for a high pressure fuel system of a cylinder injection type internal combustion engine according to claim 1, further comprising:

fuel intake control means for controlling the intake of the fuel to said high pressure fuel pump, wherein when abnormality of said spill valve is diagnostically determined by said abnormality diagnosing means, said fuel intake control means stops the fuel intake processing to said high pressure fuel pump.

10. An abnormality diagnosis apparatus for a high pressure fuel system of a cylinder injection type internal combustion engine according to claim 9, wherein said fuel intake control means includes a feed pump for pumping up the fuel from said fuel tank to feed the fuel to said high pressure fuel pump, and wherein when it is diagnostically determined by said abnormality diagnosing means that said spill valve suffers abnormality, operation of said feed pump is stopped.

* * * * *